US006746810B2

(12) United States Patent
Suzuki et al.

(10) Patent No.: US 6,746,810 B2
(45) Date of Patent: Jun. 8, 2004

(54) IMAGE FORMATION METHOD, REPLENISHING TONER USED IN THIS METHOD AND METHOD OF PRODUCING THE SAME, AND CARRIER-CONTAINING TONER CARTRIDGE

(75) Inventors: Chiaki Suzuki, Minamiashigara (JP); Masahiro Takagi, Minamiashigara (JP); Atsuhiko Eguchi, Minamiashigara (JP); Satoshi Inoue, Minamiashigara (JP); Sakon Takahashi, Minamiashigara (JP); Masahiro Uchida, Minamiashigara (JP); Rieko Kataoka, Minamiashigara (JP); Hiroyuki Fukuda, Minamiashigara (JP); Fusako Kiyono, Minamiashigara (JP); Eiji Iwasaki, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 115 days.

(21) Appl. No.: 10/105,255

(22) Filed: Mar. 26, 2002

(65) Prior Publication Data

US 2003/0148203 A1 Aug. 7, 2003

(30) Foreign Application Priority Data

Oct. 31, 2001 (JP) ..... 2001-335325

(51) Int. Cl.[7] ..... G03G 21/10
(52) U.S. Cl. ..... 430/126; 430/111.1; 399/358
(58) Field of Search ..... 430/126, 111.1, 430/110.3, 111.35, 125, 137.1; 399/358, 174

(56) References Cited

U.S. PATENT DOCUMENTS

| | | | | |
|---|---|---|---|---|
| 4,614,165 A | * | 9/1986 | Folkins et al. | 430/120 |
| 6,333,131 B1 | * | 12/2001 | Ishiyama et al. | 430/108.6 |
| 6,391,510 B1 | * | 5/2002 | Ishiyama et al. | 430/111.4 |

FOREIGN PATENT DOCUMENTS

| | | |
|---|---|---|
| JP | A 6-35286 | 2/1994 |
| JP | A 6-35287 | 2/1994 |
| JP | A 6-100195 | 4/1994 |
| JP | A 8-234550 | 9/1996 |
| JP | A 10-312089 | 11/1998 |
| JP | A 11-202630 | 7/1999 |

* cited by examiner

*Primary Examiner*—John Goodrow
(74) *Attorney, Agent, or Firm*—Oliff & Berridge, PLC

(57) ABSTRACT

An image formation method which remarkably extends developer life while providing size reduction and high speed coloring. Also, a replenishing toner and a method of producing the same, and a toner cartridge. In the image formation method, conducting image formation by an image formation apparatus having a plurality of xerography units, the developer apparatus of at least one xerography unit has a developer recovering mechanism appropriately replenishing a replenishing toner composed of a toner and a carrier into the developer apparatus and recovering an excess portion of a developer from the equipment. The above-mentioned replenishing toner has a carrier content in the range of 5 to 40% by weight, the above-mentioned carrier is a carrier coated with a resin having a specific composition, and/or the above-mentioned toner is in a specific shape. The replenishing toner may be produced using the above-mentioned recovered developer.

22 Claims, 2 Drawing Sheets

IMAGE FORMATION METHOD, REPLENISHING TONER USED IN THIS METHOD AND METHOD OF PRODUCING THE SAME, AND CARRIER-CONTAINING TONER CARTRIDGE

BACKGROUND OF THE INVENTION

1. Field of the Invention

The present invention relates to an image formation method comprising developing an electrostatic latent image to form an image by a method such as an electrophotography method, electrostatic recording method and the like, a replenishing toner used in this method and a method of producing the same, and a carrier-containing toner cartridge.

2. Description of the Related Art

In an electrophotography method, an electrostatic latent image formed on the surface of an electrostatic latent image holding member (photorecepter) is developed with a toner containing a colorant, the resulting toner image is transferred onto an image-receiving member such as paper and the like, and this is fixed by a heat roll and the like, to give an image. On the other hand, the surface of an electrostatic latent image holding member after transfer of a toner image is generally cleaned for forming an electrostatic latent image again.

Dry developers used in such an electrophotography method are roughly classified into one-component developers which provide single use of a toner produced by compounding a colorant and the like with a bonding resin, and two-component developers obtained by mixing the above-mentioned toner with a carrier. One-component developers can be classified into magnetic one-component developers which use a magnetic powder and convey an image with a developer holding member by magnetic force and cause development, and non-magnetic one-component developers which convey an image with a developer holding member by electric charge and cause development, without using a magnetic powder.

From the later period of the nineteen eighties, the market of electrophotography has received requirements for size reduction and increase in functions using a key word, digitization, and particularly with respect to full color image quality, high grade printing, and high image quality near silver halide photography are desired. As the means for attaining high image quality, digitization treatment is essential, and as the effect of such digitization regarding image quality, an ability of carrying out complicated image processing at high speed is mentioned. By this, letters and photography images can be controlled separately, and reproducibility of both qualities is improved as compared with analogy technologies. Particularly regarding photography images, that gradation correction and color correction have become possible is a great merit, and advantages exist in the points of gradation property, definition, sharpness, color reproduction and graininess as compared with an analog method.

For output of an image, a latent image made by an optical system is required to be correctly converted into an image, the particle size of a toner is further decreasing, and there is an accelerated action intending correct reproduction. Only by decrease in the particle size of a toner, however, it is difficult to stably obtain an image of high image quality, improvements of basic properties in development, transfer and fixing properties are further important.

In the case of obtaining color images, three-color or four-color toners are piled to form images, generally.

Therefore, when any of these color toners exhibits different properties from the initial properties from the standpoints of development, transfer and fixing, or a different ability from those of other colors, decrease in color reproduction, deterioration in graininess, uneven color and the like would be caused. For maintaining an image of stable high quality like the initial state even with the lapse of time, the way to stably control properties of color toners is important.

Recently, from the standpoint of increase in speed in obtaining color images (may simply be referred to as "color speed up"), there is adopted a so-called tandem development system using a plurality of xerography units composed of a developer apparatus containing a developer holding member, and of an electrostatic latent image holding member and the like, and from the standpoint of trying to reduce the size of an apparatus due to need for space saving, the sizes of the electrostatic latent image holding members are intended to be reduced. Further, there are a lot of patent applications regarding the tandem development system (Japanese Patent Application Laid-Open (JP-A) Nos. 6-35287, 6-100195, and the like).

When such a tandem development system is adopted, increase in speed of color image formation becomes easier as compared with a rotary development system, however, also in trying to obtain an image of single color such as black and the like, it is general that developer holding members of other colors also come into contact with the electrostatic latent image holding member and, simultaneously, forced to rotate toward the process direction. In such as case, a developer receives large stress, decrease in the charging ability of a developer is induced, and decrease in a developing ability and decrease in a transferring ability are easily caused, finally, leading to lowering of image quality. Further, in the tandem development system, due to restriction of space around an electrostatic latent image holding member and the size of an apparatus, the size of one developer apparatus is limited, and sufficient developer amount cannot be secured in each developer apparatus from the standpoint of space. Therefore, a developer tends to receive larger stress from apparatus-structural point of view. Consequently, deterioration of a developer occurs and the developer would be changed, this leads to remarkable increase in service cost.

As means for suppressing deterioration of a developer, JP-A No. 8-234550 discloses a technology using several kinds of replenishing toners containing carriers having different physical properties. In this technology, toner flowability and toner inter-color property and the like are influenced by change of physical properties of carriers, leading to a complicated control system, increase in the size of an apparatus, or increase in cost. JP-A No. 11-202630 discloses a technology of replenishing a replenishing toner containing a carrier having a charge amount higher than that of a carrier used in the start developer. These technologies are very effective in that the developer life is elongated, however, when image stability is taken into consideration, it is important that developer physical properties are not changed by environments and lapse of time, and it is difficult to control this change into micro level.

On the other hand, also a toner has a problem that irregularity of the form and particle size of a toner causes irregularity of the charging property of a toner, toners having excellent charging property are selectively consumed and toners having low charging property remain in a developer apparatus, to cause lowering of developing property as the whole developer, indicating selective development. When deterioration of a developer progresses due to the selective development, necessity to change a developer occurs, leading to remarkable increase in service cost. Particularly in the tandem development system, since sufficient developer amount cannot be secured in each developer apparatus from the standpoint of space, deterioration of a developer because of irregularity of the charging property of a toner progresses easily, and it is desired to improve a property to maintain a developer also from the standpoint of a toner.

Further, it is reported that toners are stirred in a developer apparatus and fine structural change on the surface of a toner occurs easily, to significantly change transferring property (JP-A No. 10-312089). Because of fine structural change of the surface of a toner, irregularity of the charging property of a toner tends to increase, resulting in promotion of the above-mentioned selective development, and the problem of decrease in developer maintaining property becomes further remarkable.

SUMMARY OF THE INVENTION

Therefore, the present invention is intended to solve the above-mentioned conventional problems and to attain the following object. Namely, an object of the present invention is to provide an image formation method which remarkably elongates the developer life and can also realize maintenance-free operation, using a tandem type image formation apparatus which corresponds to size reduction and high speed coloring, a replenishing toner used in this method and a method of producing the same, and a carrier-containing toner cartridge.

The present inventors have intensively studied, and resultantly found that it is effective to adopt a so-called trickle developing system having a replenishing system and a discharging system to replenish appropriately a replenishing toner composed of a toner and a carrier into a developer apparatus and recovering an excess portion of the above-mentioned developer from the equipment in the tandem type image formation apparatus, and to use a specific carrier or toner as the above-mentioned replenishing toner, leading to completion of the present invention.

According to a first aspect of the present invention, there is provided an image formation method of conducting image formation by an image formation apparatus having a plurality of xerography units containing an electrostatic latent image holding member; a charging means for charging the surface of the electrostatic latent image holding member; a latent image forming means for forming a latent image on the surface of the above-mentioned electrostatic latent image holding member charged; a developer apparatus accommodating a developer composed of a toner and a carrier and developing the above-mentioned latent image by a layer of the above-mentioned developer formed on the surface of the developer holding member, to form a toner image on the surface of the above-mentioned electrostatic latent image holding member; and a transferring means for transferring the above-mentioned toner image onto an image-receiving member, wherein the developer apparatus of at least one xerography unit in the above-mentioned image formation apparatus has a developer recovering mechanism replenishing appropriately the replenishing toner composed of a toner and a carrier into the developer apparatus and recovering an excess portion of the above-mentioned developer from the equipment, the above-mentioned replenishing toner has a carrier content in the range of 5 to 40% by weight, the above-mentioned carrier is produced by coating a resin containing a conductive material on a core material and the above-mentioned resin for coating a core material is a copolymer composed of a monomer containing a carboxyl group, a monomer containing fluorine, a branched alkyl methacrylate monomer having 3 to 10 carbon atoms, and an alkyl methacrylate monomer containing a linear alkyl group having 1 to 3 carbon atoms and/or an alkyl acrylate monomer containing a linear alkyl group having 1 to 3 carbon atoms.

According a second aspect of the present invention, there is provided an image formation method of conducting image formation by an image formation apparatus having a plurality of xerography units containing an electrostatic latent image holding member; a charging means for charging the surface of the electrostatic latent image holding member; a latent image forming means for forming a latent image on the surface of the above-mentioned electrostatic latent image holding member charged; a developer apparatus accommodating a developer composed of a toner and a carrier and developing the above-mentioned latent image by a layer of the above-mentioned developer formed on the surface of the developer holding member, to form a toner image on the surface of the above-mentioned electrostatic latent image holding member; and a transferring means for transferring the above-mentioned toner image onto an image-receiving member, wherein the developer apparatus of at least one xerography unit in the above-mentioned image formation apparatus has a developer recovering mechanism replenishing appropriately the replenishing toner composed of a toner and a carrier into the developer apparatus and recovering an excess portion of the above-mentioned developer from the equipment, the above-mentioned replenishing toner has a carrier content in the range of 5 to 40% by weight, the above-mentioned toner has a volume average particle size of 3 to 10 $\mu$m and the toner shape factor SF1 of the formula (1) is from 110 to 135:

$$SF1=R^2/A\times\pi/4\times100$$

(wherein, R represents the maximum length of a toner, and A represents a projected area of a toner.).

In these image formation methods of the present invention (when simply referred to as "image formation method of the present invention", it means both of the image formation method of the present invention according to the first aspect and the image formation method of the present invention according to the second aspect.), it is preferable that the above-mentioned xerography unit having a xerography unit contains further a means of cleaning the surface of an electrostatic latent image holding member after transfer of a toner image by the above-mentioned transferring means.

As described above, the present invention enables provision of an image excellent in image stability by using a developing system and a developer exhibiting little change over a long period of time in physical properties such as charging deterioration, resistance change and the like, in a tandem type image formation apparatus having a plurality of electrostatic latent image holding members and developer holding members and which is required to have high reliability.

Specifically, a trickle developing system is adopted, and in the present invention according to the first aspect, a copolymer obtained by combining specific monomers is used as a coating resin of a resin-coated layer of a carrier, and in the present invention according to the second aspect, a toner having a form near sphere is used. For attaining high image quality at high level, it is preferable to combine the present invention according to the first aspect and the present invention according to the second aspect.

According to the present invention of the first aspect, it is possible to provide a carrier for developing an electrostatic latent image and a developing system which are excellent in charging property under high humidity, suppress charge increase under low humidity, prevent peeling of a resin-coated layer, cause no easy adhesion of a toner and outer additives, cause no change of flowability and conveyability of developer, and excellent in maintenance property. Further, by placing a conductive material in the form of a matrix in a resin-coated layer, it is possible to form an image causing little change in resistance over a long period of time even if it receives carrier—carrier stress and carrier-toner stress and having high image quality.

On the other hand, according to the present invention according to the second aspect, flowability, charging property and transferring property are improved because a toner having high sphericity (near sphere) is used. Particularly, since the form of a toner is near sphere and the forms are totally uniform, irregularity of charging properties of toners is suppressed, problems owing to selective development are reduced, and the maintenance property of a developer is improved. Further, since the form of a toner is near sphere, change in fine structure of the surface of a toner is not caused easily and selective development is not promoted, even by various stresses.

Further, the image formation method of the present invention can be applied suitably to an image formation apparatus which can change process speed automatically or manually by given conditions.

In the above-mentioned xerography unit having a developer recovering mechanism, it is preferable that the above-mentioned charging means is a charging equipment of roll charging mode.

On the other hand, the replenishing toner of the present invention is characterized in that it is used in the above-mentioned image formation method of the present invention, and it is preferable to produce the replenishing toner by selecting carriers from an excess developer recovered by the above-mentioned developer recovering mechanism in the above-mentioned image formation method of the present invention, and mixing these as all or a part of carriers into a toner. In this procedure, the volume specific resistivity of all carriers mixed into a toner is preferably from $10^7$ to $10^{14}$ Ω·cm.

The carrier-containing toner cartridge of the present invention is a toner cartridge for replenishing a replenishing toner into a developer apparatus of an image formation apparatus, and characterized in that it accommodates the above-mentioned replenishing toner of the present invention.

DESCRIPTION OF THE PREFERRED EMBODIMENTS

Figure 1:
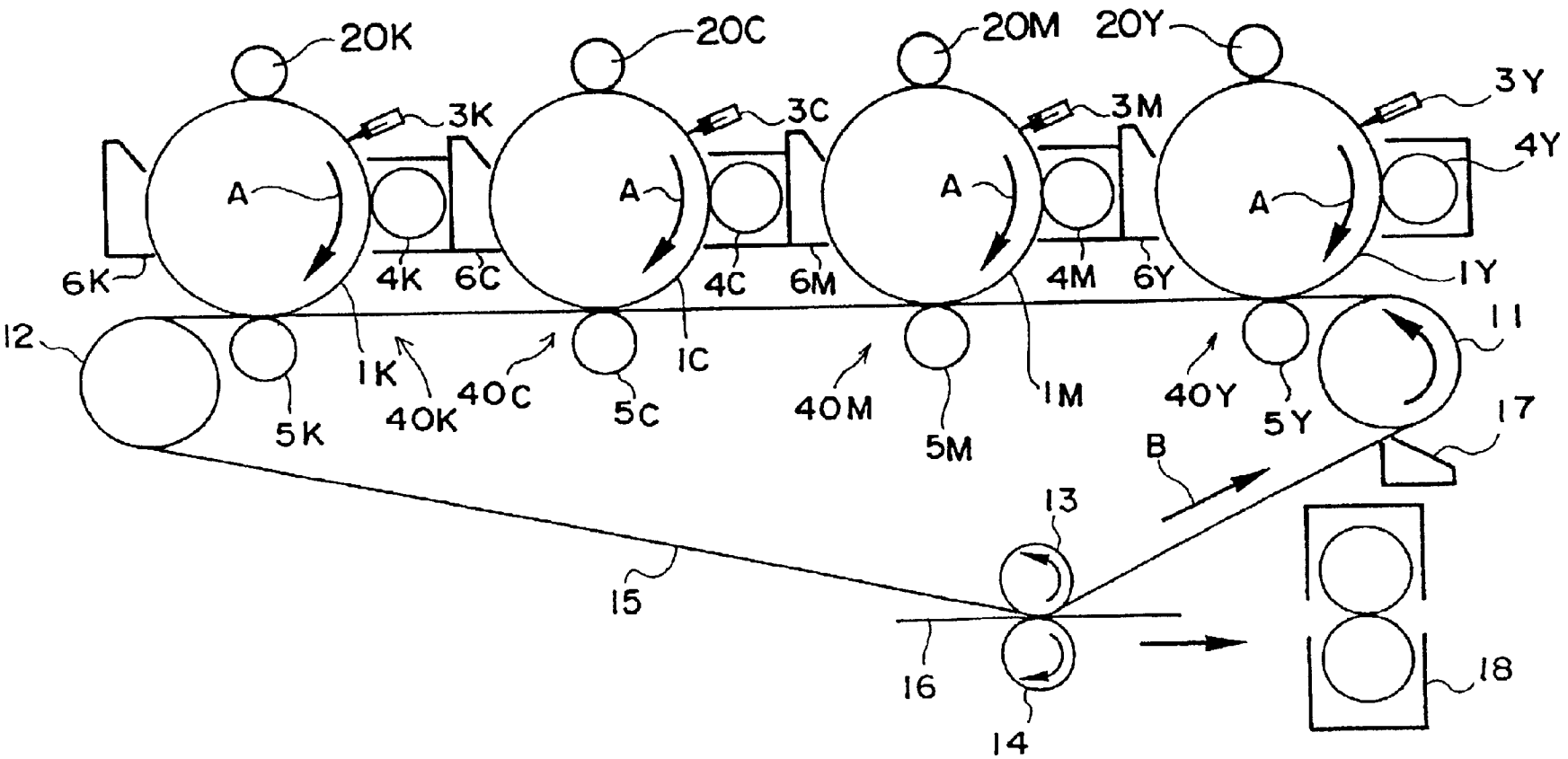
FIG. 1 is a schematic sectional view showing one example of an image formation apparatus used in the present invention.

The present invention is described in detail below.

A. Image Formation Method

The image formation method of the present invention has features in a carrier in the invention of the first aspect and in a toner in the invention of the second aspect, respectively, and first, these both features will be described before explanation of contents common to the invention of the first aspect and the invention of the second aspect.

[Constitution Specific to Invention of First Aspect]

In the present invention according to the first aspect, it is characterized in that a carrier used is produced by coating a resin containing a conductive material on a core material and this resin coating a core material is a copolymer composed of a monomer containing a carboxyl group, a monomer containing fluorine, a branched alkyl methacrylate monomer having 3 to 10 carbon atoms, and an alkyl methacrylate monomer containing a linear alkyl group having 1 to 3 carbon atoms and/or an alkyl acrylate monomer containing a linear alkyl group having 1 to 3 carbon atoms.

By using a carrier having such constitution, it is possible to exhibit high image quality for a long period of time without significantly changing volume specific resistivity even if peeling of a resin-coated layer occurs. For an object of charge control, a resin particle can be used together and dispersed in a coating resin.

The monomer containing a carboxyl group is compounded for improving close adherence with a core material. By inclusion of a polymerization unit derived from a monomer containing a carboxyl group, the close adherence of a coating resin particularly to a metal core material is improved, and peeling from a core material is prevented even under various stresses.

Examples of the monomer containing a carboxyl group include, but not limited to, unsaturated carboxylic acids such as acrylic acid, vinylacetic acid, allylacetic acid, 10-undecenic acid and the like, styrene derivatives having a carboxyl group such as carboxylstyrene, monomers containing two or more carboxyl groups such as p-carboxylstyrene.

The monomer containing a carboxyl group is suitably compounded in an amount of 0.1 to 15.0% by weight based on all monomers constituting a coating resin, and it is more preferable to control the amount in the range from 0.5 to 10.0% by weight, for effecting close adherence and stability under environment of a coating resin. When the compounding amount of the monomer containing a carboxyl group is less than 0.1% by weight, charge level is deficient, the close adherence of a coating resin to a carrier core material lowers, the coating resin is peeled, and friction thereof cannot be suppressed, in some cases. On the other hand, when over 15.0% by weight, the viscosity of a coating resin increases and uniform formation of a coat on a core material is difficult, resulting in occurrence of charge trouble in some cases.

The monomer containing fluorine is compounded for improving maintaining property by prevention of pollution. By inclusion of a polymerization unit derived from the monomer containing fluorine, the surface energy is reduced, and adhesion of a pollutant in receiving various stresses is prevented.

As the monomer containing fluorine, tetrafluoropropyl methacrylate, pentafluoro methacrylate, octafluoropentyl methacrylate, perfluorooctylethyl methacrylate, trifluoroethyl methacrylate and the like, and fluoroalkyl methacrylate-based monomers containing fluorine are suitable. However, the monomer is not limited to them.

The monomer containing fluorine is suitably compounded in an amount of 0.1 to 50.0% by weight, more preferably of 0.5 to 40.0% by weight based on all monomers constituting a coating resin. When the compounding amount is less than 0.1% by weight, it is difficult to secure pollution resistance, and when over 50.0% by weight, the close adherence of a coating resin to a core material decreases, and charging property lowers in some cases.

The branched alkyl methacrylate monomer having 3 to 10 carbon atoms (hereinafter, simply abbreviated as "branched monomer having 3 to 10 carbon atoms") is compounded to suppress environment dependence. By the existence of branching, decrease in the glass transition temperature (Tg) as the whole coating resin is prevented, and variation of properties of a carrier caused by environmental change is prevented.

Examples of the branched monomer having 3 to 10 carbon atoms include, but not limited to, isopropyl methacrylate, tert-butyl methacrylate, isobutyl methacrylate, tert-pentyl methacrylate, isopentyl methacrylate, isohexyl methacrylate and cyclohexyl methacrylate.

The alkyl methacrylate monomer containing a linear alkyl group having 1 to 3 carbon atoms and the alkyl acrylate monomer containing a linear alkyl group having 1 to 3 carbon atoms (hereinafter, both are integrally referred simply to as "linear monomer having 1 to 3 carbon atoms") are compounded for improvement of resin strength. By inclusion of a polymer unit derived from the linear monomer having 1 to 3 carbon atoms, the glass transition temperature (Tg) and mechanical strength of the whole coating resin are improved. Both of or any one of the above-mentioned two kinds of liner monomers having 1 to 3 carbon atoms may be used.

Examples of the alkyl methacrylate monomer containing a linear alkyl group having 1 to 3 carbon atoms include methyl methacrylate, ethyl methacrylate and propyl methacrylate. On the other hand, examples of the alkyl acrylate monomer containing a linear alkyl group having 1 to 3 carbon atoms include, but no limited to, methyl acrylate, ethyl acrylate and propyl acrylate.

The weight ratio of the linear monomer having 1 to 3 carbon atoms to the branched monomer having 3 to 10 carbon atoms is preferably controlled within the range from 10:90 to 90:10 since charging property, coating strength and flowability can be secured in good balance in this range. The preferable range of the above-mentioned monomers is from 20:80 to 80:20.

These monomers can be copolymerized by radical polymerization. As the copolymerization, random copolymerization, graft copolymerization, block copolymerization and the like are listed, and any of them may be adopted provided that a copolymer defined in the present invention according to the first aspect is finally obtained for exhibition of the effect of the present invention.

As the above-mentioned conductive material which can be added to a resin-coated layer, there are exemplified metals such as gold, silver and copper, and titanium oxide, zinc oxide, barium sulfate, aluminum phosphate, potassium titanate, tin oxide, carbon black and the like, and of them, carbon black is suitable from the standpoints of uniform dispersion into a resin and resistance control. However, the conductive material is not limited to them. The content of the above-mentioned conductive material is preferably from 1 to 50 parts by weight, more preferably from 3 to 20 parts by weight based on 100 parts by weigh of a resin.

Regarding the core material of a carrier, a magnetic powder is used alone as the core material, or a magnetic powder is micronized and dispersed in a resin to give a core material. As the material of this magnetic powder, magnetic metals such as iron, nickel, cobalt and the like, magnetic oxides such as ferrite, magnetite and the like are listed.

As the method of micronizing a magnetic powder and dispersing the resulting powder in a resin, there are a method in which a resin and a magnetic powder is kneaded and ground, a method in which a resin and a magnetic powder are melted and spray-dried, a method in which a magnetic powder-containing resin is polymerized in a solution by using a polymerization production method, and other methods. The above-mentioned carrier preferably contains a magnetic powder of fine particle in an amount of 80% by weight or more based on the total weight of the carrier, to suppress splashing of the carrier.

The volume average particle size of the above-mentioned core material is generally from 10 to 500 $\mu$m, preferably from 25 to 80 $\mu$m.

As the method of forming the above-mentioned resin-coated layer on the surface of a carrier, there are an immersion method in which a coated-layer forming solution containing the above-mentioned resin, conductive material and solvent is prepared and a carrier core material is immersed in this solution, a spray method in which a coated-layer forming solution is sprayed on the surface of a carrier core material, a fluidized bed method in which a coated-layer forming solution is sprayed under condition in which a carrier core material is floated by flow air, a kneader coater method in which a carrier core material and a coated-layer forming solution are mixed in a kneader coater and a solvent is removed, and other methods.

The solvent used to prepare the above-mentioned coated-layer forming solution is not particularly restricted provided it dissolves the above-mentioned resin, and for example, aromatic hydrocarbons such as toluene, xylene and the like, ketones such as acetone, methyl ethyl ketone and the like and ethers such as tetrahydrofuran, dioxane and the like can be used.

The above-mentioned resin-coated layer has an average film thickness of usually from 0.1 to 10 $\mu$m, and in the present invention, preferably from 0.5 to 3 $\mu$m for exhibiting stable volume specific resistivity of a carrier for a certain period.

The carrier used in the present invention has a volume specific resistivity of preferably from $10^6$ to $10^{14}$ Ω·cm, more preferably from $10^8$ to $10^{13}$ Ω·cm for attaining high image quality, at 1000 V corresponding to the upper lower limit of usual development contrast potential. When the volume specific resistivity of a carrier is less than $10^6$ Ω·cm, reproducibility of a fine line is poor, and toner fogging on a background part due to injection of electric charge tends to occur. On the other hand, when the volume specific resistivity of a carrier is over $10^{14}$ Ω·cm, reproduction of black solid and half tone deteriorates. Further, the amount of a carrier moving onto a photorecepter (electrostatic latent image holding member) increases, leading to a tendency of scratching of a photorecepter.

[Constitution Specific to Invention of Second Aspect]

In the present invention according to the second aspect, it is characterized in that a toner used has a volume average particle size of 3 to 10 $\mu$m, and the toner shape factor SF1 of the formula (1) is from 110 to 135:

$$SF1=R^2/A\times\pi/4\times100$$

(wherein, R represents the maximum length of a toner, and A represents a projected area of a toner.).

"Toner" defined in the present invention according to the second aspect indicates a mother particle of the toner excepting outer additives if added, and is generally called also "toner particle" or "coloring particle". In the following explanations, this is referred to as "toner particle" in some cases, for disambiguating a difference from a toner composition containing outer additives added.

In the present invention according to the second aspect, the volume average particle size of a toner particle is in the range from 3 to 10 μm. By controlling the volume average particle size of a toner particle within this range, a highly fine image can be obtained, and powder flowability, charging stability, transferring property and the like are also excellent. The volume average particle size of a toner particle is preferably in the range from 3 to 6 μm particularly from the standpoint of high image quality.

In the present invention according to the second aspect, it is essential that the toner shape factor SF1 of the formula (1) is from 110 to 135. By controlling the toner shape factor SF1 within the above-mentioned range, high developing property and transferring property and an image of high quality can be obtained. Further, since the form is near sphere and uniform totally, irregularity of the charging property of a toner is suppressed, a problem due to selective development is decreased, and the maintaining property of a developer is improved. Further, since the form of a toner is near sphere, change in fine structure of the surface of a toner is not caused easily and selective development is not promoted, even by various stresses.

In the present invention according to the second aspect, the toner shape factor SF1 is obtained by sampling toner particles intended to be measured, and analyzing toner particles photographed by an optical microscope by an image analysis apparatus, and a value obtained by averaging values of 1000 toner particles is used as the toner shape factor SF1. In the case of real sphere, the toner shape factor SF1 is 100, and when it is higher, an irregular form differing from real sphere is obtained.

In the present invention according to the second aspect, the method of producing a toner (toner particle) is not particularly restricted, and for obtaining a toner particle of excellent sphericity SF described previously, it is desirable to produce a toner by a wet production method. As the wet production method, there are listed an emulsion aggregation method in which a polymerizable monomer of a binder resin is emulsion-polymerized, and the formed dispersion is mixed a dispersion of a colorant and releasing agent, and if necessary, a charge controlling agent and the like, and the mixture is coagulated and coalesced with heat to obtain a toner particle; a suspension polymerization method in which a polymerizable monomer for obtaining a binder resin, and a solution of a colorant and releasing agent, if necessary, a charge controlling agent and the like are suspended in an aqueous solvent and polymerized; a solution suspension method in which a solution of a binder resin, a colorant and releasing agent, if necessary, a charge controlling agent and the like is suspended in an aqueous solvent and granulated; and the like. Further, it is also permissible that a toner particle obtained in the above-mentioned method is used as a core, and further, a coagulation particle is adhered on it and coalesced with heat to give a core-shell structure. Furthermore, it is also permissible that the toner shape factor SF1 is regulated in a given range by performing on a toner particle obtained by a general grinding classification method a spherization treatment in which the particle is melted with heat and solidified again.

[Constitution Common to Invention if First Aspect and Invention of Second Aspect]

As described above, the image formation method of the present invention has features in a carrier in the invention of the first aspect and in a toner in the invention of the second aspect, respectively, and a toner in the invention of the first aspect and in a carrier in the invention of the second aspect are not particularly restricted. However, for attaining high image quality at high level, it is preferable to combine the present invention according to the first aspect and the present invention according to the second aspect.

Hereinafter, explanations are made, mainly on constitutions common to the present invention according to the first aspect and the present invention according to the second aspect, regarding preferable aspects for both of them.

<Developer>

The term developer used in the present invention includes a developer accommodated previously in a developer apparatus (hereinafter, referred to as "start developer" in some cases) and a replenishing toner, and they are different only in compounding ratio and basically the similar composition.

(Carrier)

Regarding the carrier used in the present invention, specific carriers described above are used in the present invention according to the first aspect, and there is no restriction in the present invention according to the second aspect and known carriers can be used. For example, a resin-coated carrier having a resin-coated layer on the surface of a core material is mentioned. It may also be a magnetic particle dispersed type carrier in which a magnetic material and the like are dispersed in a matrix resin.

Examples of the coating resin/matrix resin used in the carrier in the present invention according to the second aspect include, but not limited to, polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, vinyl chloride-vinyl acetate copolymer, styrene-acrylic acid copolymer, straight silicone resin containing an organosiloxane bond or modified products thereof, fluorine resins, polyesters, polyurethanes, polycarbonates, phenol resins, amino resins, melamine resins, benzoguanamine resins, urea resins, amide resins, epoxy resins and the like.

Examples of the conductive material include, but not limited to, metals such as gold, silver and copper, and carbon black, further, titanium oxide, zinc oxide, barium sulfate, aluminum borate, potassium titanate, tin oxide, carbon black and the like.

As the core material of a carrier, magnetic metals such as iron, nickel, cobalt and the like, magnetic oxides such as ferrite, magnetite and the like, glass beads and the like are listed, and magnetic materials are preferable for use of a carrier in a magnetic brush method.

The volume average particle size of a core material of a carrier is generally from 10 to 500 μm, preferably from 30 to 100 μm.

For coating a resin on the surface of a core material of a carrier, there is mentioned a method in which a coated-layer forming solution prepared by dissolving the above-mentioned coating resin, and if necessary, various outer additives in a suitable solvent is coated. The solvent is not particularly restricted and may advantageously be selected appropriately in view of a coating resin used, application suitability and the like.

As the specific resin coating method, there are listed an dipping method in which a core material of a carrier is dipped in a coated-layer forming solution, a spray method in which a coated-layer forming solution is sprayed on the surface of a core material of a carrier, a fluidized bed method in which a coated-layer forming solution is sprayed under condition in which a carrier core material is floated by flow air, a kneader coater method in which a carrier core material and a coated-layer forming solution are mixed in a kneader coater and a solvent is removed, and other methods.

(Toner)

As described above, the shape factor SF1 of a toner (toner particle) is restricted in the present invention according to the second aspect, however, not restricted in the present invention according to the first aspect. Other constitutions are summarized below since they are common to the present invention according to the first aspect and the present invention according to the second aspect.

The toner (toner particle) used in the present invention contains at least a binder resin and a colorant, and if necessary, a releasing agent and other components. Further, it is desirable that outer additives are added for various objects, in addition to a so-called toner particle having the above-mentioned constitution, to a toner used in the present invention.

Binder Resin

As the above-mentioned binder resin, there are exemplified homopolymers and copolymers of styrenes such as styrene, chlorostyrene and the like; monoolefins such as ethylene, propylene, butylenes, isoprene and the like; vinyl esters such as vinyl acetate, vinyl propionate, vinyl benzoate, vinyl butyrate and the like; α-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate and the like; vinyl ethers such as vinyl methyl ether, vinyl ethyl ether, vinyl butyl ether and the like; vinyl ketones such as vinyl methyl ketone, vinyl hexyl ketone, vinyl isopropenyl ketone and the like; and as the particularly typical binder resin, polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene and the like are listed. Further, polyesters, polyurethanes, epoxy resins, silicone resins, polyamides, modified rosins, paraffin waxes and the like are listed.

Colorant

As the above-mentioned colorant, for example, magnetic powders such as magnetite, ferrite and the like, carbon black, aniline blue, chalcoyl blue, chrome yellow, ultramarine blue, Dupont oil red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, C. I. Pigment Blue 15:3 and the like are typically exemplified.

The addition amount of the above-mentioned colorant is, when a pigment or a dye is used, preferably from 3 to 20 parts by weight, more preferably from 4 to 10 parts by weight based on 100 parts by weight of the above-mentioned binder resin. When this addition amount is less than 3 parts by weight, the coloring performance of a toner may be insufficient, and the amount is preferably as large as possible in the range in which smoothness on the surface of an image after fixing is not disturbed. When the content of a colorant is increased, the thickness of an image can be decreased in obtaining an image of the same concentration, providing merits in increase in image quality and prevention of offset.

When magnetite or ferrite is used as the above-mentioned colorant, the addition amount thereof is from 3 to 60 parts by weight, preferably from 10 to 30 parts by weight based on 100 parts by weight of the above-mentioned binder resin.

Releasing Agent

As the above-mentioned releasing agent, lower molecular weight polyethylene, lower molecular weight polypropylene, Fischer-Tropsch wax, montan wax, carnauba wax, rice wax, candelilla wax and the like are typically exemplified.

The addition amount of the above-mentioned releasing agent is preferably from 1 to 15 parts by weight, more preferably from 3 to 10 parts by weight based on 100 parts by weight of the above-mentioned binder resin. When the addition amount is less than 1 part by weight, the effect may not be exhibited, on the other hand, when over 15 parts by weight, flowability deteriorates remarkably and charge distribution is significantly enlarged, in some cases.

Other Components

In the present invention, a charge controlling agent may be added, if necessary, to a toner. As the charge controlling agent, known agents can be used, and azo-based metal complex compounds, metal complex compounds such as salicylic acid, and charge controlling agents of resin type containing a polar group can be preferably used. Particularly, when a toner is produced by a wet production method, it is preferable to use a material which is not easily dissolved in water from the standpoints of control of ionic strength and lowering of waste water pollution. In the present invention, the toner may be any of a magnetic toner containing a magnetic material, and a non-magnetic toner containing no magnetic material.

Outer Additive

The outer additive added to a toner used in the present invention is not particularly restricted, and various outer additives used conventionally as the outer additive can be used without problem. For example, for the purpose of improving charging property, conductivity, powder flowability, lubricating property and the like, fine particles of metals, metal oxides, metal salts, ceramics, resins, carbon black and the like may be added.

Though the development and transfer process is influenced also by uniform conveyability of a developer, electric current in transfer, and the like, it is basically a process in which a toner particle is detached from the constraining force of a support supporting a toner particle (carrier or electrostatic latent image holding member) and allowed to move to the subject (electrostatic latent image holding member or image-receiving member). Therefore, the development and transfer process is affected by balance of "Coulomb's force" and "adhesion force of a toner particle with a carrier (toner charging member) or a toner particle with an electrostatic latent image holding member". Though control of this balance is very difficult, this process influences directly image quality and when efficiency is improved, there are prospected improvement in reliability and power saving due to cleaning-less and the like. Therefore, in the above-mentioned process, higher development and transferring property are required.

Such development and transfer occurs when "Coulomb's force" is larger than "adhesion force". Therefore, for improving the efficiency of development and transfer, it may be advantageous to make a control so as to increase electrostatic attractive force (increase development and transfer force) or to decrease adhesion force. When development and transfer force is strengthen, for example, when transfer electric field is increased, secondary troubles tend to occur such as generation of a reverse polar toner, and the like. Namely, decrease in adhesion force is more effective.

As the adhesion force, Van der Waals force (non-electrostatic adhesion force) and image force due to charge carried by a toner particle are listed. There is a level difference near 1 order between them, and it is interpreted that the adhesion force is discussed almost by Van der Waals force. Van der Waals force between spherical particles is represented by the following formula (2).

$$F=H\cdot r1\cdot r2/6(r1+r2)\cdot a^2 \quad (2)$$

(H: constant, r1, r2: radii of two particles coming into contact, a: inter-particle distance)

For lowering of adhesion force, a method is effective in which fine particles having very small r as compared with that of a toner particle are allowed to present between toner particles and the surface of an electrostatic latent image holding member or the surface of a toner charging member, to give a distance a between them, and further, contact area (contact points) is reduced. Stable duration of this effect can be attained by using mono-dispersed spherical silica.

When a toner having a shape near sphere is used as in the present invention according to the second aspect, it is generally difficult to clean an electrostatic latent image holding member. Usually, the blade pressure of a cleaning blade is optimized to secure given cleaning property, and it is effective, in addition to this, to use mono-dispersed spherical silica having a true specific gravity of 1.3 to 1.9 and a volume average particle size of 80 to 300 nm as the outer additive to a toner. The reason for this is that by using such mono-dispersed spherical silica, adhesion force of a toner with an electrostatic latent image holding member can be decreased, and blade passing (cleaning failure) due to rolling of toners near contact part between a cleaning blade and an electrostatic latent image holding member can be suppressed.

On the other hand, owing to a discharge product formed on an electrostatic latent image holding member by a charge roll, friction coefficient of a cleaning blade with an electrostatic latent image holding member is increased, strain is allowed to occur in a cleaning blade according to change of process speed, and blade-squeal, cleaning failure and the like are caused, in some cases. Since the amount of the discharge product is in proportion to current value and discharging number, when switching from high speed mode to normal mode or low speed mode is for example conducted in an apparatus which can change process speed, process speed decreases under condition in which the discharge product stays at contact part of a cleaning blade and an electrostatic latent image holding member, consequently, problems such as strain of a cleaning blade, blade-squeal, cleaning failure and the like become remarkable.

For preventing such problems, it is effective to use an abrasive and lubricant together as outer additives in a toner. By addition of an abrasive, the discharge product can be polished and refreshed. Further, an abrasive is not transferred itself easily and remains on an electrostatic latent image holding member though it has the above-mentioned effects such as discharge product removal and the like, therefore, blade abrasion and blade tearing force increase and it is difficult to maintain a stable cleaning ability, however, by using a lubricant together, it is possible to maintain a sharp blade edge and clean a blade over a long period of time.

Therefore, in the present invention, it is desirable to use mono-dispersed spherical silica and/or a combination of an abrasive and a lubricant, as the outer additive to a toner. The outer additive is not, of course, restricted the them, and other outer additives may also be contained in the present invention.

(a) Mono-Dispersed Spherical Silica

Mono-dispersed spherical silica particularly preferably used in the present invention is characteristic in that it has a true specific gravity of 1.3 to 1.9 and a volume average particle size of 80 to 300 nm.

By controlling the true specific gravity to 1.9 or less, peeling from a toner particle can be suppressed. By controlling the true specific gravity to 1.3 or more, coagulation dispersion can be suppressed. Preferably, the true specific gravity of the mono-dispersed spherical silica in the present invention is from 1.4 to 1.8. Since the above-mentioned mono-dispersed spherical silica is mono-dispersed and has a spherical form, it can be dispersed uniformly on the surface of a toner particle, to obtain stable spacer effect.

On the other hand, when the volume average particle size of the above-mentioned mono-dispersed spherical silica is less than 80 nm, there is a tendency that it does not act effectively on decrease in non-electrostatic adhesion force. Particularly due to stress in a developer apparatus, the silica tends to be buried in toner particles, and an effect of improving development and transfer tends to lower remarkably. On the other hand, when over 300 nm, the silica tends to be released from a toner particle, does not act effectively on decrease in non-electrostatic adhesion force and tends to move to a contact member, causing a tendency of occurrence of secondary troubles such as charge disturbance, image quality defect and the like. Preferably, the volume average particle size of mono-dispersed spherical silica in the present invention is from 100 to 200 nm.

Definition of mono-dispersion in the present invention can be discussed based on the standard deviation against the average particle size including coagulated bodies, and the standard deviation is preferably volume average particle size $D_{50}\times 0.22$ or less. The definition of spherical form in the present invention can be discussed based on sphericity of Wadell represented by the following formula (3), and the sphericity is preferably 0.6 or more, more preferably 0.8 or more.

$$\text{Sphericity}=S1/S2 \tag{3}$$

(wherein, S1 represents a surface area of sphere having the same volume as that of an actual particle, and S2 represents a surface area of an accrual particle itself.)

The reason for the fact that silica is preferable as a material is that the refractive index is around 1.5, and even if the particle size is increased, there occur no influence on decrease in transparency due to light scattering, particularly, on PE value (Projection Efficiency) in collecting an image onto OHP and the like.

General fumed silica has a true specific gravity of 2.2, and the maximum particle size of 50 nm is a limitation from the standpoint of production. Though the particle size can be increased by forming a coagulated body, uniform dispersion and stable spacer effect are not obtained easily. On the other hand, as the other typical inorganic fine particles used as outer additives, titanium oxide (true specific gravity 4.2, refractive index 2.6), alumina (true specific gravity 4.0, refractive index 1.8) and zinc oxide (true specific gravity 5.6, refractive index 2.0) are listed, however, any of them has high true specific gravity, and when the particle size is over 80 nm by which a spacer effect is effectively exhibited, peeling from a toner particle tends to occur, the pealed particle tends to move to a toner charging member or an electrostatic latent image holding member and the like, causing decrease in charge or image defect, in some cases. Further, since the refractive index thereof is also high, use of these large particle size inorganic materials is not suitable for color image formation.

Mono-dispersed spherical silica can be obtained by a sol-gel method which is a wet method. The true specific gravity can be controlled at low level as compared with a vapor phase oxidation method, due to a wet method and production without calcinations. The true specific gravity value can be further controlled by controlling the kind of a hydrophobization treating agent or the treating amount in a hydrophobization treatment process. The particle size can be freely controlled by hydrolysis in a sol-gel method, alkoxysilane, ammonia and alcohol in a condensation polymerization process, weight ratio of water, reaction temperature, stirring speed and feeding speed. Also mono-dispersibility and spherical form desired for mono-dispersed spherical silica can be attained sufficiently by production according to this method.

As the method of producing mono-dispersed spherical silica by a sol-gel method, for example, the following method is exemplified specifically.

Tetramethoxysilane or tetraethoxysilane is dropped and stirred in the presence of water and alcohol, using ammonia water as a catalyst, while heating. Then, a silica sol suspension obtained by the reaction is centrifugally separated for separation into wet silica gel, alcohol and ammonia water. A solvent is added to wet silica gel to provide a condition of silica sol again, and a hydrophobization treating agent is added to effect hydrophobization of the surface of silica. Then, a solvent is removed from this hydrophobization-treated silica sol which is then dried and sieved, to obtain the intended mono-dispersed spherical silica. Further, thus obtained silica may be subjected to the treatment again.

In the present invention, the method of producing mono-dispersed spherical silica is not restricted to the above-mentioned production method.

As the above-mentioned silane compound, water-soluble compounds can be used.

As this silane compound, compounds of the chemical structural formula $RaSiX_{4-a}$ (wherein, a represents an integer of 0 to 3, R represents a hydrogen atom, or an organic group such as an alkyl group and alkenyl group and the like, and X represents a chlorine atom, or a hydrolysable group such as a methoxy group and ethoxy group and the like.) can be used, and any type of compound of chlorosilane, alkoxysilane, silazane and special silylating agent can be used.

As the above-mentioned silane compound, there are specifically exemplified methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl) ethyltrimethoxysilane, γ-glycidoxypropyltrimethoxysilane, γ-glycidoxypropylmethyldiethoxysilane, γ-mercaptopropyltrimethoxysilane and γ-chloropropyltrimethoxysilane, as typical examples.

As the above-mentioned hydrophobization treating agent, dimethyldimethoxysilane, hexamethyldisilazane, methyltrimethoxysilane, isobutyltrimethoxysilane, decyltrimethoxysilane and the like are particularly preferably mentioned.

The addition amount of the above-mentioned mono-dispersed spherical silica is preferably from 0.5 to 5 parts by weight, more preferably from 1 to 3 parts by weight based on 100 parts by weight of a toner particle. When this addition amount is less than 0.5 parts by weight, an effect of reducing non-electrostatic adhesion force and, an effect of improving development and transfer is not obtained sufficiently, in some cases. On the other hand, when more than 5 parts by weight, the addition amount is over the amount which can provide a one-layer film on the surface of a toner particle, coating condition is excess, and silica moves to a contact member, consequently, secondary problems are caused easily.

(b) Abrasive

As the preferable abrasive which can used in the present invention, there are generally exemplified cerium oxide, silicon carbide, strontium titanate, alumina, titania, complex materials and the like, however, the abrasive is not limited to them. Of them, cerium oxide is most preferable.

The average particle size of the above-mentioned abrasive is preferably in the range from 0.1 to 2 μm. The addition amount of the above-mentioned abrasive to a toner particle is preferably from 0.3 to 2 parts by weight, more preferably from 0.5 to 1.5 parts by weight based on 100 parts by weight of a toner particle. When this addition amount is less than 0.3 parts by weight, an abrasion effect may not be obtained sufficiently, and when over 2 parts by weight, an abrasive promotes soft blocking of a toner, and problems such as cloud induction in development, transfer defect and the like are caused, in some cases.

(c) Lubricant

As the lubricant, solid alcohol, metal soap, lower molecular weight polyolefin and the like are exemplified. The volume average particle size of the above-mentioned lubricant is preferably from 1 to 8 μm. The addition amount of the above-mentioned lubricant to a toner particle is preferably from 0.1 to 1 part by weight, more preferably from 0.2 to 0.8 parts by weight based on 100 parts by weight of a toner particle.

(d) Other Outer Additives

In the present invention, sufficient coating of the surface of a toner particle is desired to control flowability and charging property of a toner, and sufficient coating may not be obtained only with the above-mentioned mono-dispersed spherical silica having large particle size, therefore, it is preferable to use an inorganic compound having small particle size together. As the inorganic compound having small particle size, inorganic compounds having a volume average particle size of 80 nm or less are preferable, and inorganic compounds having a volume average particle size of 50 nm or less are more preferable.

As the inorganic compound having small particle size, known compounds can be used. For example, silica, alumina, titanium compounds (titanium oxide, m-titanic acid and the like), calcium carbonate, magnesium carbonate, calcium phosphate and the like are listed. Further, known surface treatments may also be performed on the surface of these inorganic particles according to the object.

Particularly, of them, titanium compounds of 15 to 50 nm do not exert an influence on transparency, and can provide a developer having excellent charging property, environmental stability, flowability, caking resistance, stable negative charging property, and stable image quality maintaining property.

Further, by use of silica having a volume average particle size of 20 to 50 nm together, a toner can be coated uniformly, and suppressing of blocking of a toner and improvement of initial transferring property are possible.

In the present invention, the above-mentioned outer additives are added to a toner particle and mixed, and the mixing can be conducted, for example, by a known mixing machine such as a V-shaped blender, Henschel mixer, LÖDIGE mixer and the like.

Further, in this procedure, various outer additives may be added, if necessary. As the outer additive, other fluidization agents, cleaning aids such as a polystyrene fine particle, polymethyl methacrylate fine particle, polyvinylidene fluoride fine particle and the like, or transfer aids and the like are listed.

The addition amounts of the titanium compound of 15 to 50 nm and silica of 20 to 50 nm are preferably from 0.3 to 3 parts by weight, more preferably from 0.5 to 2.5 parts by weight based on 100 parts by weight of a toner particle. When this addition amount is less than 0.3 parts by weight, flowability of a toner may not be obtained sufficiently, and suppressing of blocking by heat storage tends to be insufficient. On the other hand, when this addition amount is more than 3 parts by weight, excess coating condition is obtained, and an excess inorganic oxide moves to a contact member, to cause secondary problems in some cases.

In the present invention, adhesion condition of the above-mentioned outer additive to the surface of a toner particle may be simply mechanical adhesion, or the outer additive may be loosely adhered to the surface. The whole surface of a toner particle may be coated, or a part of the surface may be coated.

Further, a toner may be passed through a sieving process after mixing of outer additives, without any problem.

Next, the method of adding outer additives to the above-mentioned toner particle is illustrated.

Depending on demands, a method in which the above-mentioned mono-dispersed spherical silica and an inorganic compound of small particle size, abrasive and lubricant are simultaneously added to and mixed with a toner particle, or a method in which they are mixed step by step may be adopted.

After various investigations of the addition method, the effect of adding outer additives can be enhanced by first mixing a toner particle and mono-dispersed spherical silica having a true specific gravity of 1.3 to 1.9 and a volume average particle size of 80 to 300 nm and adding and mixing an inorganic compound, abrasive and lubricant having smaller diameter than that of the mono-dispersed spherical silica under weaker shear than the previous mixing.

In the present invention, the above-mentioned mono-dispersed spherical silica is added to a toner particle and mixed, and the mixing can be conducted, for example, by a known mixing machine such as a V-shaped blender, Henschel mixer, LÖDIGE mixer and the like.

(Preparation of Developer)

The developer used in the present invention is prepared by mixing the above-mentioned carrier and toner at suitable compounding ratio, together with a start developer and replenishing toner.

The content of a carrier in a start developer ((carrier)/(carrier+toner)×100) is preferably from 85 to 99% by weight, more preferably from 87 to 98% by weight, further preferably from 89 to 97% by weight.

On the other hand, the content of a carrier in a replenishing toner is from 5 to 40% by weight, and preferably from 6 to 30% by weight. When the content of a carrier is less than 5% by weight, charge deterioration control, resistance change prevention, and image quality change control can not be sufficiently exhibited. Developers excess in a developer apparatus are recovered from the developer apparatus, and when the content of a carrier in a replenish tone is over 40% by weight, this recovering amount is large, producing a necessity to increase the volume of a vessel for accommodating a developer after recovery, therefore, such content is not suitable for size reduction of an apparatus for which space saving is required.

<Image Formation Apparatus>

In the image formation method of the present invention, an image formation apparatus having a plurality of xerography units containing an electrostatic latent image holding member; a charging means for charging the surface of the electrostatic latent image holding member; a latent image forming means for forming a latent image on the surface of the above-mentioned electrostatic latent image holding member charged; a developer apparatus accommodating a developer composed of a toner and a carrier and developing the above-mentioned latent image by a layer of the above-mentioned developer formed on the surface of the developer holding member, to form a toner image on the surface of the above-mentioned electrostatic latent image holding member; and a transferring means for transferring the above-mentioned toner image onto an image-receiving member, namely a so-called tandem type image formation apparatus is used as the image formation apparatus of conducting image formation.

Particularly, when full color images are made in the image formation method of the present invention, it is preferable from the standpoints of paper universality and high image quality that images of respective color toners are piled by once transferring to the surface of an intermediate transfer belt or intermediate transfer drum which is an image-receiving member, then, the color toner images are transferred onto the surface of a recording medium such as paper and the like in one operation. Of course, a constitution in which a recording medium such as paper and the like is used as the image-receiving member and images of respective color toners are directly piled may also be permissible.

In the present invention, the developer apparatus of at least one xerography unit in the above-mentioned image formation apparatus adopts a so-called trickle development system which has a developer recovering mechanism replenishing appropriately the replenishing toner composed of a toner and a carrier into the developer apparatus and recovering an excess portion of the above-mentioned developer from the equipment. If at least one xerography unit adopting a trickle developing system is used, the effect of the invention is obtained in this unit, and saving of maintenance of a developer and maintenance-free operation can be realized, and of course, it is desirable that more many xerography units adopt a trickle developing system and it is most desirable that all xerography units adopt a trickle developing system.

A carrier (replenishing toner) in the trickle developing system is usually mixed in a toner, a certain amount of a carrier is to be resupplied with consumption of a toner. Further, as the general method of controlling this, there is a method in which a toner is sequentially resupplied and controlled so that the toner concentration is in the constant range by a toner concentration sensor in a developer apparatus. A developer in a developer apparatus reached to excess level is usually recovered by over flow and accommodated in a recovering vessel.

The image formation apparatus used in the present invention is of tandem mode having a plurality of xerography units, and constituent elements are not restricted provided that a developer apparatus of at least one xerography units adopts a trickle developing system. The image formation apparatus used in the present invention is illustrated below using one example thereof.

FIG. 1 is a schematic sectional view showing one example of the image formation apparatus used in the present invention. In this image formation apparatus, four xerography units 40Y, 40M, 40C and 40K forming images of yellow, magenta, cyan and black, respectively, are placed in parallel (in tandem form) at given distance, as shown in FIG. 1. Here, since the xerography units 40Y, 40M, 40C and 40K have basically the same constitution excepting colors of toners in a developer, the xerography unit 40Y for yellow is explained as a typical example below.

The xerography unit 40Y for yellow has a photorecepter drum (electrostatic latent image holding member) as an image holding member, and this photorecepter drum 1Y has an axis vertical to paper surface on which FIG. 1 is drawn, and driven to rotate along arrow A illustrated at a given process speed by a driving means not shown. As the photorecepter drum 1Y, for example, an organic photorecepter having sensitivity in an infrared region is used.

It may be permissible that process speed can be switched automatically or manually under given conditions. The image formation method of the present invention can realize formation of a high quality image and maintaining property of a developer even with such an apparatus in which process speed is switched during the process. Here, the phrase "automatically under given conditions" means, for example, a case in which when image information containing highly fine image parts such as a photography image and the like is input, normal mode may be automatically switched to low speed mode for obtaining a high quality image.

On the photorecepter drum 1Y in FIG. 1, a charging equipment 20Y of roll charge mode (charging means) is mounted, and given voltage is applied by an electric source not shown to the charging equipment 20Y, and the surface of the photorecepter drum 1Y is charged at give potential (the same mechanism acts also in the charging equipments 20M, 20C and 20K and the photorecepter drums 1M, 1C and 1K.).

Around the photorecepter drum 1Y, a latent image forming means 3Y which performs image-wise exposure on the surface of the photorecepter drum 1Y to form an electrostatic latent image is placed at a position which is downstream of the rotation direction of the photorecepter drum 1Y than the charging equipment 20Y. Though a LED array of which size can be reduced is used here from the standpoint of space as the latent image forming means 3Y, this is not a restrictive example, and other latent image forming means utilizing laser beam and the like may also be used of course without problem.

Around the photorecepter drum 1Y, a developer apparatus 4Y of yellow color is placed at a position which is downstream of the rotation direction of the photorecepter drum 1Y than the latent image formation means 3Y, and an electrostatic latent image formed on the surface of the photorecepter drum 1Y is made clear with a toner of yellow color to form a toner image on the surface of the photorecepter drum 1Y.

Under the photorecepter drum 1Y in FIG. 1, an intermediate transfer belt 15 which provides primary transfer of a toner image formed on the surface of the photorecepter drum 1Y is placed so that it passes under the photorecepter drums 1Y, 1M, 1C and 1K, and this intermediate transfer belt 15 is pushed to the surface of the photorecepter drum 1Y by a primary transfer roll 5Y. The intermediate transfer belt 15 is tensed by a driving means composed of three rolls, a driving roll 11, supporting roll 12 and backup roll 13, and circulates along the direction of arrow B at the same moving speed as the process speed of the photorecepter drum 1Y. On the surface of the intermediate transfer belt 15, toners images of magenta, cyan and black are primary-transferred sequentially in addition to the toner image of yellow color primary-transferred as described above, and they are piled.

Around the photorecepter drum 1Y, a cleaning means 6Y composed of a cleaning blade for cleaning a toner remaining on the surface of the photorecepter drum 1Y and a toner re-transferred is placed at a position which is downstream of the rotation direction (direction of arrow A) of the photorecepter drum 1Y than the primary transfer roll 5Y, and the cleaning blade in the cleaning means 6Y is so mounted that it contacts the surface of the photorecepter drum 1Y toward the counter direction.

On the backup roll 13 giving tension of the intermediate transfer belt 15, a secondary transfer roll 14 is pressed via the intermediate transfer belt 15, and a toner image primary-transferred and piled on the surface of the intermediate transfer belt 15 is transferred electrostatically to the surface of an image-receiving member 16 fed from a paper cassette not shown, at a nip part of the backup roll 13 and secondary transfer roll 14.

Further, on the periphery of the intermediate transfer belt 15, a cleaning member 17 for the intermediate transfer belt is so placed as to contact the surface of the intermediate transfer belt 15, at a position approximately corresponding to the surface of the driving roll 11.

Under the driving roll 11 of the intermediate transfer belt 15 in FIG. 1, a fuser 18 is placed for transferring toner images multi-transferred on the image-receiving member 16 to the surface of the image-receiving member 16 with heat and pressure to give a permanent image.

Then, the movements of the xerography units 40Y, 40M, 40C and 40K forming images of yellow, magenta, cyan and black, respectively, constituted as described above, are illustrated. Since the movements of the xerography units 40Y, 40M, 40C and 40K are the same, the movement of the xerography unit 40Y of yellow color is illustrated as a typical example thereof.

In the xerography unit 40Y of yellow color, the photorecepter drum 1Y rotates at given process speed along the direction of arrow A, and the surface of the photorecepter drum 1Y is charged at given negative potential by electric discharged occurring in fine clearance between the charging equipment 20Y and the photorecepter drum 1Y or injection of charge, by applying given voltage to the charging equipment 20Y by an electric source not shown. Thereafter, on the surface of the photorecepter drum 1Y, image-wise exposure is performed by the latent image forming means 3Y, to form an electrostatic latent image corresponding to image information. Subsequently, the electrostatic latent image formed on the surface of the photorecepter drum 1Y is visualized on the surface of the photorecepter drum 1Y by reversal development of a toner negatively charged by the developer apparatus 4Y, to form a toner image. Thereafter, the toner image on the surface of the photorecepter drum 1Y is primary-transferred to the surface of the intermediate transfer belt 15 by the primary transfer roll 5Y. After primary transfer, a toner and the like remaining on the surface of the photorecepter drum 1Y are scraped off by the cleaning blade of the cleaning means 6Y and the photorecepter drum 1Y is cleaned, in preparation for the following image forming process.

The above-mentioned movements are conducted in xerography units 40Y, 40M, 40C and 40K, resultantly, toner images visualized on the surfaces of the photorecepter drums 1Y, 1M, 1C and 1K are sequentially multi-transferred to the surface of the intermediate transfer belt 15. In full color mode, toner images of yellow, magenta, cyan and black are multi-transferred in this order, and also in mono-color, two-color and three-color modes, the same order is applied, and only toner images of necessary colors are mono-transferred or multi-transferred. Thereafter, the toner images mono-transferred or multi-transferred to the surface of the intermediate transfer belt 15 are secondary-transferred to the surface of an image-receiving member 16 carried from a paper cassette not shown by the secondary transfer roll 14, subsequently, fixed by being heated and pressed in the fuser 18. A toner remaining on the surface of the intermediate transfer belt 15 after secondary transfer is cleaned by a cleaning member 17 which is a cleaning blade for the intermediate transfer belt 15.

As described above, in the present invention, the developer apparatus of at least any one xerography unit (at least any one of 4Y, 4M, 4C and 4K) among the xerography units 40Y, 40M, 40C and 40K adopts a trickle developing system, this developer apparatus accommodates the developer according to the present invention according to the first aspect and/or the present invention according to the second aspect described previously.

In the above-mentioned tandem mode image formation apparatus, high speed coloring is easy as compared with a rotary development system, however, also when a black image is to be obtained using only the xerography unit 40K for example, the xerography units 40Y, 40M and 40C of other colors also operate together, and developer holding members contained in the developer apparatuss 4Y, 4M and 4C rotate with the photorecepter drums 1Y, 1M and 1C, therefore, stresses received by developers accommodated in the developer apparatuss 4Y, 4M and 4C would be extremely large. Further, due to restriction of spaces around the photorecepter drums 1Y, 1M, 1C and 1K or the size of an apparatus, the sizes of the developer apparatuss 4Y, 4M, 4C and 4K are limited and sufficient developer amount can not be secured in each developer apparatus from the standpoint of space, therefore, stress received by a developer tends to increase also owing to the structure of an apparatus.

However, in the image formation method of the present invention, at least any one of the developer apparatuss 4Y, 4M, 4C and 4K adopts a trickle developing system, further, a replenishing toner having high maintaining property is resupplied to this. Consequently, the life of a developer is elongated remarkably, and maintenance-free operation is also realized.

In the image formation apparatus using the image formation method of the present invention, constituent members are not particularly restricted excepting definitions in the present invention. For example, as constituent elements such as an electrostatic latent image holding member, intermediate transfer belt (or intermediate transfer drum), charging equipment and the like, any known elements can be adopted.

However, as the above-mentioned charging means, it is preferable to adopt a charging equipment of roll charge mode since environment safety due to decrease in ozone generation, and the like can be realized at high levels.

As the cleaning means 6Y, a means of blade cleaning mode is preferably used in general due to excellent ability stability, and is adopted also in the above-mentioned example. For enabling cleaning of a toner near sphere, it is desired to control physical properties of a blade and optimize contact conditions, and additionally, by use of the above-mentioned developer defined in the present invention, particularly, a developer containing a toner to which outer additives including previously described mono-dispersed spherical silica, abrasive and lubricant in combination are added, a toner remaining on the surface of an electrostatic latent image holding member can be stably cleaned and the life of an electrostatic latent image holding member can be extended owing to friction resistance thereof. Further, an electrostatic brush may be placed at a position which is upstream or downstream of a cleaning means along the rotation direction of an electrostatic latent image holding member.

As the above-mentioned electrostatic brush, it is possible to use a fibrous substance composed of a resin containing a conductive filler such as carbon black, metal oxide and the like, or a fibrous substance having surface coated with the above-mentioned conductive filler, however, the brush is not limited to them.

The image formation method of the present invention has been illustrated above using a drawing of one example of the image formation apparatus used in the image formation method of the present invention, however, the present invention permits any change and modification regarding other optional elements based on known information and is not limited providing the constitutions of the present invention are included.

B. Replenishing Toner and Production Method Thereof

The replenishing toner of the present invention is characterized in that it is used in the image formation method of the present invention described above. The replenishing toner of the present invention includes developers containing two kinds of constitutions according to the present invention according to the first aspect and the present invention according to the second aspect regarding the image formation method, or a developer having both constitutions. Specifically, the following three aspects (a) to (c) are mentioned.

(a) A carrier contained in a replenishing toner is produced by coating a resin containing a conductive material on a core material and the above-mentioned resin for coating a core material is a copolymer composed of a monomer containing a carboxyl group, a monomer containing fluorine, a branched alkyl methacrylate monomer having 3 to 10 carbon atoms, and an alkyl methacrylate monomer containing a linear alkyl group having 1 to 3 carbon atoms and/or an alkyl acrylate monomer containing a linear alkyl group having 1 to 3 carbon atoms.

(b) A toner contained in a replenishing toner has a volume average particle size of 3 to 10 $\mu$m and the toner shape factor SF1 of the formula (1) is from 110 to 135:

$$SF1=R^2/A\times\pi/4\times100$$

(wherein, R represents the maximum length of a toner, and A represents an projected area of toner.).

(c) A combination of the above-mentioned carrier (a) and toner (b).

Details and preferable aspects and the like of the replenishing toner in the present invention are as described in detail in the column of "A. Image formation apparatus".

The replenishing toner in the present invention is produced, as described previously, by mixing given toners and carriers. The replenishing toner may also be produced by selecting carriers from an excess developer recovered by the above-mentioned developer recovering mechanism in the above-mentioned image formation method of the present invention, and mixing these as all or a part of carriers into a toner.

In the image information method of the present invention, an excess developer is recovered from a developer with replenishment of a replenishing toner since a trickle developing system is adopted, and it is preferable to select carriers from the recovered developer and further to use them as at least a part of a replenishing toner since these can contribute also to saving of resources.

In this case, when the volume specific resistivity of the above-mentioned selected carrier is in the range from $10^7$ to $10^{14}$ Ωcm, all of carriers of replenishing toners produced can be replaced by this reproduced carrier, and when out of the above-mentioned range, it is preferable to, for example, control the volume specific resistivity by mixing with a new carrier, to restrict the resistance within the above-mentioned range. By restriction of the volume specific resistivity of a carrier within the above-mentioned range, excellent charging property on a toner is secured, leading to totally a property like a new product. The volume specific resistivity of the whole carrier mixed into a toner is preferably in the range from $10^8$ to $10^{13}$ Ωcm.

C. Carrier-Containing Toner Cartridge

In an image formation apparatus of trickle development mode, a carrier-containing toner cartridge accommodating a replenishing toner is mounted, and the replenishing toner is resupplied into a developer apparatus of the image formation apparatus continuously or intermittently. As the replenish tone accommodated in such a carrier-containing toner cartridge, the above-mentioned replenishing toner of the present invention is preferably accommodated.

EXAMPLES

The following examples illustrate the present invention specifically, but do not limit the scope of the invention at all. In the following explanations, "parts" are all by weight.

[Measuring Methods]

In the following examples and comparative examples, measurements on toners, carriers and developers are conducted according to the following methods.

<Measurement of True Specific Gravity>

The true specific gravity is measured according to JIS-K-0061, 5-2-1 using Le Chatelier's specific gravity bottle. The operation is conducted described below.

(1) About 250 ml of ethyl alcohol is charged into a Le Chatelier's specific gravity bottle, and controlled so that meniscus reaches the graduation.

(2) A specific gravity bottle is immersed in a constant temperature water tank, and when the liquid temperature reaches 20.0±0.2° C., the position of meniscus is correctly read based on graduation of the specific gravity bottle (accuracy 0.025 ml).

(3) About 100 g of a sample is weighed, and the weight is precisely measured and represented by W (g).

(4) A sample weighed is charged into a specific gravity bottle, and bubble in the liquid is removed.

(5) A specific gravity bottle is immersed in a constant temperature water tank, and when the liquid temperature reaches 20.0±0.2° C., the position of meniscus is correctly read based on graduation of the specific gravity bottle (accuracy 0.025 ml).

(6) The true specific gravity is calculated by the following formula.

$$D=W/(L2-L1)$$

$$S=D/0.9982$$

In the formulae, D represents the density (g/cm$^3$) of a sample (20° C.), S represents the true specific gravity of a sample (20° C.), W represents the weight of a sample (g), L1 represents the read value (ml) of meniscus before charging of a sample in a specific gravity bottle (20° C.), L2 represents the read value (ml) of meniscus after charging of a sample in a specific gravity bottle (20° C.), and 0.9982 is the density of water (g/cm$^3$) at 20° C.

<Measurement of Primary Particle Size of Outer Additive and Standard Deviation Thereof>

These are measured by using a laser diffraction/scattering type particle size distribution measuring apparatus (HORIBA LA-910).

<Sphericity of Outer Additive>

As the sphericity ψ of an outer additive, the sphericity of Wadell represented by the following formula (3) is adopted.

$$\text{Sphericity } \psi=S1/S2 \quad (3)$$

(wherein, S1 represent the surface area of sphere having the same volume as that of an actual particle, and S2 represents the surface area of an actual particle itself.).

In this case, S1 is calculated from the average particle size. S2 is substituted by the BET specific surface area using a powder specific surface area measuring apparatus, SS-100 type, manufactured by Shimadzu Corp.

<Toner Shape Factor SF1 of a Toner Particle>

The toner shape factor SF1 of a toner particle is as described previously, and specifically, is measured by inputting an enlarged image of a toner image into an image analysis apparatus (LUZEX III, manufactured by Nireco Corporation) from an optical microscope, and analyzing this.

<Shape Factor of Carrier>

The shape factor of a carrier is measured by the same manner as for the above-mentioned toner shape factor SF1 of a toner particle.

<Measurement of Saturated Magnetization>

A constant amount of a sample is collected as a VSM normal temperature sample case powder (H-2902-151) and weighed precisely, then, the saturated magnetization is measured in a magnetic field of 398 kA/m (5 kOe), using a vibration sample type magnetometer, BHV-525 (manufactured by Riken Denshi K. K.).

<Measurement of Volume Specific Resistivity>

Figure 2:
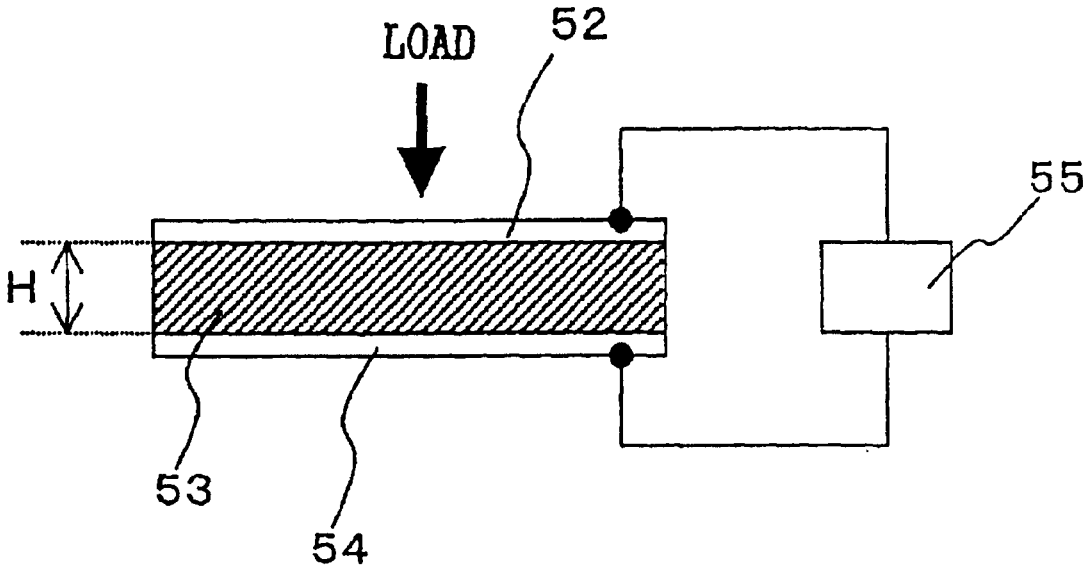
FIG. 2 is a schematic illustration view for illustrating a method of measuring the volume specific resistivity of a carrier.

Measurement of the volume specific resistivity is conducted using an apparatus shown in FIG. 2. As shown in FIG. 2, a measurement sample 53 is sandwiched by a lower electrode 54 and an upper electrode 52, and the thickness H of the measurement sample 53 is measured by a dial gauge while pressing from the upper side, and the volume specific resistivity of the measurement sample 53 is measured by a high voltage resistance meter.

Specifically, when titanium oxide as an outer additive is used as the measurement sample 53, a measurement disk of 100 mmϕ and a thickness of about 2 mm is produced by applying a pressure of 500 kg/cm$^2$ to a molding machine, then, the surface of the disk is cleaned with a brush and sandwiched between an upper electrode 52 and a lower electrode 54 (both electrodes have 100 mmϕ) in a cell, and the thickness H is measured by a dial gauge. Then, voltage is applied by the high voltage resistance meter, and the current value is read, to show the volume specific resistivity.

On the other hand, when a carrier is used as the measurement sample 53, the carrier is charged in a lower electrode of 100 mmϕ and an upper electrode 52 of the same diameter is set, and a load of 3.43 kg is applied thereon, and the thickness H is measured by a dial gauge. Then, voltage is applied by the high voltage resistance meter, and the current value is read, to show the volume specific resistivity.

[Outer Additives]

In the following examples and comparative examples, any outer additives of the following (A) to (K) are used as the outer additive to an toner.

(A) Mono-Dispersed Spherical Silica A

Silica sol obtained by a sol-gel method is subjected to hydrophobization treatment with hexamethyldisilazane (hereinafter, simply referred to as HMDS treatment), dried and ground to give spherical mono-dispersed silica A having a true specific gravity of 1.50, a sphericity ψ of 0.85 and a volume average particle size $D_{50}$ of 135 nm (standard deviation=29 nm).

(B) Mono-Dispersed Spherical Silica B

Silica sol obtained by a sol-gel method is subjected to HMDS treatment, dried and ground to give spherical mono-dispersed silica B having a true specific gravity of 1.60, a sphericity ψ of 0.90 and a volume average particle size $D_{50}$ of 80 nm (standard deviation=13 nm).

(C) Mono-Dispersed Spherical Silica C

Silica sol obtained by a sol-gel method is subjected to HMDS treatment, dried and ground to give spherical mono-dispersed silica C having a true specific gravity of 1.50, a sphericity ψ of 0.70 and a volume average particle size $D_{50}$ of 100 nm (standard deviation=40 nm).

(D) Fumed Silica D

A commercially available fumed silica RY50 (manufactured by Nippon Aerosil Co., Ltd.) having a true specific gravity of 2.2, a sphericity ψ of 0.58 and a volume average particle size $D_{50}$ of 40 nm (standard deviation=20 nm) is prepared, and this is used as fumed silica D.

(E) Silicone Resin Fine Particle

A silicone resin fine particle having a true specific gravity of 1.32, a sphericity ψ of 0.90 and a volume average particle size $D_{50}$ of 500 nm (standard deviation=100 nm) is prepared.

(F) Polymethyl Methacrylate Resin Particle

A polymethyl methacrylate resin particle having a true specific gravity of 1.16, a sphericity ψ of 0.95 and a volume average particle size $D_{50}$ of 300 nm (standard deviation=100 nm) is prepared.

(G) Fumed Silica G

A commercially available fumed silica RX200 (manufactured by Nippon Aerosil Co., Ltd.) having a true specific gravity of 2.2, a sphericity ψ of 0.40 and a volume average particle size $D_{50}$ of 12 nm (standard deviation=5 nm) is prepared, and this is used as fumed silica G.

(H) Titanium Oxide (a)

A commercially available rutile type titanium oxide, MT-3103 (manufactured by Tayca Corporation) having a true specific gravity of 4.2, a minor diameter of 15 nm and a major diameter of 35 nm is prepared, and this is used as titanium oxide (a).

(I) Titanium Oxide (b)

A commercially available anatase type titanium oxide, STT-65C (manufactured by Titan Kogyo K. K.) having a true specific gravity of 4.2, and a volume average particle size $D_{50}$ of 50 nm, and this is used as titanium oxide (b).

(J) Lubricant (a)

Solid alcohol UNILIN (manufactured by Toyo-Petrolite Co., Ltd.) is ground to prepare a lubricant in solid form having a volume average particle size of 5 μm, and this is used as lubricant (a).

(K) Lubricant (b)

Commercially available metal soap (zinc stearate, manufactured by Sakai Chemical Industry Co., Ltd.) [volume average particle size 3 μm] is used as it is, and this is used as lubricant (b).

(L) Cerium Oxide

Commercially available cerium oxide, E10 (manufactured by Mitsui Mining & Smelting Co., Ltd.) [volume average particle size 0.7 μm] is used as it is.

[Production of Toner Particle]

(Production of Toner Particle A (Black))

Styrene-n-butyl acrylate copolymer (Tg=58° C., Mn=4000, Mw=24000) 100 parts by weight Carbon black (Mogul L: manufactured by Cabot Corporation) 3 parts by weight A mixture of the above-mentioned components is kneaded by an extruder, ground by a jet mill, then, dispersed by a wind force type classification machine, to produce toner particle A (black) having a volume average particle size $D_{50}$ of 5.0 μm and a toner shape factor SF1 of 139.8.

(Production of Toner Particle B (Black))

Production of Resin Dispersion (1)

| | |
|---|---|
| Styrene | 370 g |
| n-butyl acrylate | 30 g |
| Acrylic acid | 8 g |
| Dodecane thiol | 24 g |
| Carbon tetrabromide | 4 g |

The above-mentioned components are mixed and dissolved, and this solution is emulsified and dispersed, in a flask, into a solution prepared by dissolving 6 g of a nonionic surfactant (Nonipol 400: manufactured by Sanyo Chemical Industries, Ltd.) and 10 g of an anionic surfactant (Neogen SC: manufactured by Dai-ichi Kogyo Seiyaku Co., Ltd.) in 550 g of ion exchanged water, and to this is added a solution prepared by dissolving 4 g of ammonium persulfate into 50 g of ion exchanged water, while mixing slowly for 10 minutes. After purged with nitrogen, the above-mentioned flask is heated in an oil bath until the content reached 70° C. while stirring, and emulsion-polymerization is continued under the same condition for 5 hours. As a result, a resin dispersion (1) containing a dispersed resin particle having an average particle size of 155 nm, a Tg of 59° C. and a weight average molecular weight Mw of 12000 is obtained.

Production of Resin Dispersion (2)

| | |
|---|---|
| Styrene | 280 g |
| n-butyl acrylate | 120 g |
| Acrylic acid | 8 g |

The above-mentioned components are mixed and dissolved, and this solution is emulsified and dispersed, in a flask, into a solution prepared by dissolving 6 g of a nonionic surfactant (Nonipol 400: manufactured by Sanyo Chemical Industries, Ltd.) and 12 g of an anionic surfactant (Neogen SC: manufactured by Dai-ichi Kogyo Seiyaku Co., Ltd.) in 550 g of ion exchanged water, and to this is added a solution prepared by dissolving 3 g of ammonium persulfate into 50 g of ion exchanged water, while mixing slowly for 10 minutes. After purged with nitrogen, the above-mentioned flask is heated in an oil bath until the content reached 70° C. while stirring, and emulsion-polymerization is continued under the same condition for 5 hours. As a result, a resin dispersion (2) containing a dispersed resin particle having an average particle size of 105 nm, a Tg of 53° C. and a weight average molecular weight Mw of 550000 is obtained.

Production of Colorant Dispersion (1)

| | |
|---|---|
| Carbon black (Mogul L: manufactured by Cabot Corporation) | 50 g |
| Nonionic surfactant (Nonipol 400: manufactured by Sanyo Chemical Industries, Ltd.) | 5 g |
| Ion exchanged water | 200 g |

The above-mentioned components are mixed and dissolved, and dispersed for 10 minutes by using a homogenizer (UltraTalax T50: manufactured by IKA K. K.), to prepare a colorant dispersion (1) containing a dispersed colorant (carbon black) particle having an average particle size of 250 nm.

Releasing Agent Dispersion

| | |
|---|---|
| Paraffin wax (HNP0190: manufactured by Nippon Seiro Co., Ltd., melting point 85° C.) | 50 g |
| Cationic surfactant (Sanisol B50: manufactured by Kao Corp.) | 5 g |
| Ion exchanged water | 200 g |

The above-mentioned components are mixed, heated at 95° C., and dispersed for 10 minutes by using a homogenizer (UltraTalax T50: manufactured by IKA K. K.) in a round stainless steel flask, then, dispersed by a pressure discharge type homogenizer, to prepare a releasing agent dispersion containing a dispersed releasing agent particle having an average particle size of 550 nm.

Production of Toner Particle B (Black)

| | |
|---|---|
| Resin dispersion (1) | 120 g |
| Resin dispersion (2) | 80 g |
| Colorant dispersion (1) | 200 g |
| Releasing agent dispersion | 40 g |
| Cationic surfactant (Sanisol B50: manufactured by Kao Corp.) | 1.5 g |

The above-mentioned components are mixed and dispersed by using a homogenizer (UltraTalax T50: manufactured by IKA K. K.) in a round stainless steel flask, then, the dispersion is heated up to 50° C. while stirring the content in the flask in a heating oil bath. The dispersion is kept at 45° C. for 20 minutes, then, observed by an optical microscope, to confirm formation of a coagulated particle having a volume average particle size of about 4.0 $\mu$m. Further, to the above-mentioned mixed liquid is added 60 g of the resin dispersion (1) gently. The temperature of the heating oil bath is raised to 50° C. and kept for 30 minutes. The dispersion is observed by an optical microscope, to confirm formation of a coagulated particle having a volume average particle size of about 4.8 $\mu$m.

To the above-mentioned mixed liquid is added 3 g of an anionic surfactant (Neogen SC: manufactured by Dai-ichi Kogyo Seiyaku Co., Ltd.), then, the above-mentioned stainless steel flask is sealed, and heated up to 105° C. while stirring and kept for 4 hours, using magnetic seal. Then, the solution is cooled, then, the reaction product is filtrated, and washed fully with ion exchanged water, and dried, to produce toner particle B (black). The resulting toner particle B (black) had a toner shape factor SF1 of 118.5 and a volume average particle size $D_{50}$ of 5.2 $\mu$m.

Production of Toner Particle B (Cyan)

A toner particle B (cyan) having a toner shape factor SF1 of 119 and a volume average particle size $D_{50}$ of 5.4 $\mu$m is produced in the same manner as for (Production of toner particle B (black)) excepting the following colorant dispersion (2) is used instead of the colorant dispersion (1) in (Production of toner particle B (black)).

Production of Colorant Dispersion (2)

| | |
|---|---|
| Cyan pigment: C.I. Pigment Blue 15:3 | 70 g |
| Nonionic surfactant (Nonipol 400: manufactured by Sanyo Chemical Industries, Ltd.) | 5 g |
| Ion exchanged water | 200 g |

The above-mentioned components are mixed and dissolved, and dispersed for 10 minutes by using a homogenizer (UltraTalax T50: manufactured by IKA K. K.), to prepare a colorant dispersion (2) containing a dispersed colorant (cyan pigment) particle having an average particle size of 250 nm.

Production of Toner Particle B (Magenta)

A toner particle B (magenta) having a toner shape factor SF1 of 120.5 and a volume average particle size $D_{50}$ of 5.5 $\mu$m is produced in the same manner as for (Production of toner particle B (black)) excepting the following colorant dispersion (3) is used instead of the colorant dispersion (1) in (Production of toner particle B (black)).

Production of Colorant Dispersion (3)

| | |
|---|---|
| Magenta pigment: C.I. Pigment Red 122 | 70 g |
| Nonionic surfactant (Nonipol 400: manufactured by Sanyo Chemical Industries, Ltd.) | 5 g |
| Ion exchanged water | 200 g |

The above-mentioned components are mixed and dissolved, and dispersed for 10 minutes by using a homogenizer (UltraTalax T50: manufactured by IKA K. K.), to prepare a colorant dispersion (3) containing a dispersed colorant (magenta pigment) particle having an average particle size of 250 nm.

Production of Toner Particle B (Yellow)

A toner particle B (yellow) having a toner shape factor SF1 of 120 and a volume average particle size $D_{50}$ of 5.3 $\mu$m is produced in the same manner as for (Production of toner particle B (black)) excepting the following colorant dispersion (4) is used instead of the colorant dispersion (1) in (Production of toner particle B (black)).

Production of Colorant Dispersion (4)

| | |
|---|---|
| Yellow pigment: C.I. Pigment Yellow 180 | 100 g |
| Nonionic surfactant (Nonipol 400: manufactured by Sanyo Chemical Industries, Ltd.) | 5 g |
| Ion exchanged water | 200 g |

The above-mentioned components are mixed and dissolved, and dispersed for 10 minutes by using a homogenizer (UltraTalax T50: manufactured by IKA K. K.), to prepare a colorant dispersion (4) containing a dispersed colorant (yellow pigment) particle having an average particle size of 250 nm.

Production of Toner Particle C (Black)

| | |
|---|---|
| Resin dispersion (1) | 120 g |
| Resin dispersion (2) | 80 g |
| Colorant dispersion (1) | 200 g |
| Releasing agent dispersion | 40 g |
| Cationic surfactant (Sanisol B50: manufactured by Kao Corp.) | 1.5 g |

The above-mentioned components are mixed and dispersed by using a homogenizer (UltraTalax T50: manufactured by IKA K. K.) in a round stainless steel flask, then, the content of the flask is stirred and heated up to 50° C. while controlling pH, in a heating oil bath. After the dispersion is kept at 40° C. for 20 minutes, then, observed by an optical microscope, to confirm formation of a coagulated particle having a volume average particle size of about 5.0 $\mu$m. Further, to the above-mentioned mixed liquid is added 60 g of the resin dispersion (1) gently. The temperature of the heating oil bath is raised to 45° C. and kept for 20 minutes. The dispersion is observed by an optical microscope, to confirm formation of a coagulated particle having a volume average particle size of about 5.6 μm.

To the above-mentioned mixed liquid is added 3 g of an anionic surfactant (Neogen SC: manufactured by Dai-ichi Kogyo Seiyaku Co., Ltd.), then, the above-mentioned stainless steel flask is sealed, and heated up to 90° C. while stirring and kept for 4 hours, using magnetic seal. Then, the solution is cooled, then, the reaction product is filtrated, and washed fully with ion exchanged water, and dried, to produce toner particle C (black). The resulting toner particle C (black) had a toner shape factor SF1 of 134.5 and a volume average particle size $D_{50}$ of 5.6 μm.

Production of Toner Particle C (Cyan)

A toner particle C (cyan) having a toner shape factor SF1 of 131 and a volume average particle size $D_{50}$ of 5.7 μm is produced in the same manner as for (Production of toner particle C (black)) excepting the above-mentioned colorant dispersion (2) is used instead of the colorant dispersion (1) in (Production of toner particle C (black)).

Production of Toner Particle C (Magenta)

A toner particle C (magenta) having a toner shape factor SF1 of 130 and a volume average particle size $D_{50}$ of 5.5 μm is produced in the same manner as for (Production of toner particle C (black)) excepting the above-mentioned colorant dispersion (3) is used instead of the colorant dispersion (1) in (Production of toner particle C (black)). Production of toner particle C (yellow)-

A toner particle B (yellow) having a toner shape factor SF1 of 134 and a volume average particle size $D_{50}$ of 5.7 μm is produced in the same manner as for (Production of toner particle C (black)) excepting the above-mentioned colorant dispersion (4) is used instead of the colorant dispersion (1) in (Production of toner particle C (black)).

Production of Toner Particle D (Black)

The toner particle C (black) is subjected to hot air treatment under an atmosphere of 70° C., further, the form thereof is made close to sphere, and this is used as toner particle D (black). The toner particle D had a toner shape factor SF1 of 108.5 and a volume average particle size $D_{50}$ of 5.6 μm.

[Production of Carrier]

(Production of Carrier Coating Resin A)

50 parts by weight of methyl methacrylate, 40 parts by weight of isobutyl methacrylate, 7 parts by weight of perfluorooctylethyl methacrylate and 3 parts by weight of acrylic acid are random-copolymerized by solution polymerization using a toluene solvent, to obtain carrier coating resin A having a weight average molecular weight Mw of 48000.

(Production of Carrier Coating Resin B)

50 parts by weight of methyl methacrylate, 43 parts by weight of isobutyl methacrylate and 7 parts by weight of perfluorooctylethyl methacrylate are random-copolymerized by solution polymerization using a toluene solvent, to obtain carrier coating resin B having a weight average molecular weight Mw of 46000.

(Production of Carrier Coating Resin C)

80 parts by weight of methyl methacrylate, 15 parts by weight of styrene and 5 parts by weight of perfluorooctylethyl methacrylate are random-copolymerized by solution polymerization using a toluene solvent, to obtain carrier coating resin C having a weight average molecular weight Mw of 50000.

(Production of Carrier A)

| | |
|---|---|
| Ferrite particle (average particle size: 40 μm) | 100 parts |
| Toluene | 14 parts |
| Carrier coating resin A | 2 parts |
| Carbon black (R330: manufactured by Cabot Corporation) | 0.2 parts |
| Melamine fine particle | 0.3 parts |

First, all components of the above-mentioned components excepting the ferrite particle are stirred for 10 minutes by a stirrer, to prepare a dispersed coating layer forming solution. Then, this coating layer forming solution and the ferrite resin are placed in a vacuum deaeration type kneader and stirred for 30 minutes at 60° C., then, further deaerated under reduced pressure while heating, and dried to produce carrier A. The resulting carrier A had a shape factor of 118, a true specific gravity of 4.5, a saturated magnetization of 63 emu/g, and a volume specific resistivity in application of an electric field of 1000 V/cm of $10^{11}$ Ω·cm.

(Production of Carrier B)

| | |
|---|---|
| Ferrite particle (average particle size: 40 μm) | 100 parts |
| Toluene | 14 parts |
| Coating resin A | 1.5 parts |
| Carbon black (R330: manufactured by Cabot Corporation) | 0.2 parts |
| Melamine fine particle | 0.3 parts |

First, all components of the above-mentioned components excepting the ferrite particle are stirred for 10 minutes by a stirrer, to prepare a dispersed coating layer forming solution. Then, this coating layer forming solution and the ferrite resin are placed in a vacuum deaeration type kneader and stirred for 30 minutes at 60° C., then, further deaerated under reduced pressure while heating, and dried to produce carrier B. The resulting carrier B had a shape factor of 119, a true specific gravity of 4.5, a saturated magnetization of 63 emu/g, and a volume specific resistivity in application of an electric field of 1000 V/cm of $10^{7}$ Ω·cm.

(Production of Carrier C)

| | |
|---|---|
| Ferrite particle (average particle size: 40 μm) | 100 parts |
| Toluene | 14 parts |
| Coating resin A | 3 parts |
| Carbon black (R330: manufactured by Cabot Corporation) | 0.1 part |
| Melamine fine particle | 0.3 parts |

First, all components of the above-mentioned components excepting the ferrite particle are stirred for 10 minutes by a stirrer, to prepare a dispersed coating layer forming solution. Then, this coating layer forming solution and the ferrite resin are placed in a vacuum deaeration type kneader and stirred for 30 minutes at 60° C., then, further deaerated under reduced pressure while heating, and dried to produce carrier C. The resulting carrier C had a shape factor of 118, a true specific gravity of 4.5, a saturated magnetization of 63 emu/g, and a volume specific resistivity in application of an electric field of 1000 V/cm of $10^{14}$ Ω·cm.

(Production of Carrier D)

| | |
|---|---|
| Ferrite particle (average particle size: 40 μm) | 100 parts |
| Toluene | 14 parts |
| Coating resin A | 2 parts |
| Melamine fine particle | 0.3 parts |

First, all components of the above-mentioned components excepting the ferrite particle are stirred for 10 minutes by a stirrer, to prepare a dispersed coating layer forming solution. Then, this coating layer forming solution and the ferrite resin are placed in a vacuum deaeration type kneader and stirred for 30 minutes at 60° C., then, further deaerated under reduced pressure while heating, and dried to produce carrier D. The resulting carrier D had a shape factor of 118, a true specific gravity of 4.5, a saturated magnetization of 63 emu/g, and a volume specific resistivity in application of an electric field of 1000 V/cm of $10^{16}$ Ω·cm.

(Production of Carrier E)

| | |
|---|---|
| Ferrite particle (average particle size: 40 μm) | 100 parts |
| Toluene | 14 parts |
| Coating resin B | 2 parts |
| Carbon black (R330: manufactured by Cabot Corporation) | 0.2 parts |
| Melamine fine particle | 0.3 parts |

First, all components of the above-mentioned components excepting the ferrite particle are stirred for 10 minutes by a stirrer, to prepare a dispersed coating layer forming solution. Then, this coating layer forming solution and the ferrite resin are placed in a vacuum deaeration type kneader and stirred for 30 minutes at 60° C., then, further deaerated under reduced pressure while heating, and dried to produce carrier E. The resulting carrier E had a shape factor of 118, a true specific gravity of 4.5, a saturated magnetization of 63 emu/g, and a volume specific resistivity in application of an electric field of 1000 V/cm of $10^{11}$ Ω·cm.

(Production of Carrier F)

| | |
|---|---|
| Ferrite particle (average particle size: 40 μm) | 100 parts |
| Toluene | 14 parts |
| Coating resin C | 2 parts |
| Carbon black (R330: manufactured by Cabot Corporation) | 0.2 parts |
| Melamine fine particle | 0.3 parts |

First, all components of the above-mentioned components excepting the ferrite particle are stirred for 10 minutes by a stirrer, to prepare a dispersed coating layer forming solution. Then, this coating layer forming solution and the ferrite resin are placed in a vacuum deaeration type kneader and stirred for 30 minutes at 60° C., then, further deaerated under reduced pressure while heating, and dried to produce carrier F. The resulting carrier F had a shape factor of 118, a true specific gravity of 4.5, a saturated magnetization of 63 emu/g, and a volume specific resistivity in application of an electric field of 1000 V/cm of $10^{11}$ Ω·cm.

Example 1

To each 100 parts of the above-mentioned toner particle B (black), toner particle B (cyan), toner particle B (magenta) and toner particle B (yellow) are mixed 2 parts of the above-mentioned mono-dispersed spherical silica A, 1 part by weight of the titanium oxide (a), 0.8 parts of the fumed silica D, 0.5 parts of cerium oxide and 0.3 parts of the lubricant (a), as outer additives, and they are blended for 15 minutes at a peripheral speed of 32 m/s by a Henschel mixer, then, coarse particles are removed using a sieve of 45 μm mesh, to obtain four color toners. The resulting toners are primary-stored in hoppers respectively, and charged into a cartridge from the hoppers via an auger, then, the carrier A is charged at a ratio of 20 g of the carrier per 100 g of the toner, and wrapping is performed to obtain a toner cartridge containing four color carriers (the content of carriers in a replenishing toner is about 16.7%).

On the other hand, 8 parts of the above-mentioned toner and 100 parts of the above-mentioned carrier A are stirred for 20 minutes at 40 rpm using a V-shaped blender, and sieved through a sieve having a mesh of 177 μm, to obtain a four-color start developer.

Example 2

To 100 parts of the above-mentioned toner particle B (black) is mixed 2 parts of the above-mentioned mono-dispersed spherical silica B, 1 part by weight of the titanium oxide (a), 0.8 parts of the fumed silica D, 0.5 parts of cerium oxide and 0.3 parts of the lubricant (a), as outer additives, and they are blended for 15 minutes at a peripheral speed of 32 m/s by a Henschel mixer, then, coarse particles are removed using a sieve of 45 μm mesh, to obtain a toner. The resulting toner is primary-stored in a hopper, and charged into a carrier-containing toner cartridge from the hopper via an auger, then, the carrier A is charged at a ratio of 20 g of the carrier per 100 g of the toner, and wrapping is performed to obtain a carrier-containing toner cartridge (the content of a carrier in a replenishing toner is about 16.7%).

On the other hand, 8 parts of the above-mentioned toner and 100 parts of the above-mentioned carrier A are stirred for 20 minutes at 40 rpm using a V-shaped blender, and sieved through a sieve having a mesh of 177 μm, to obtain a start developer.

Example 3

A carrier-containing toner cartridge and a start developer are obtained in the same manner as in Example 2 except that the above-mentioned mono-dispersed spherical silica C is used instead of the mono-dispersed spherical silica B, in Example 2.

Example 4

A carrier-containing toner cartridge and a start developer are obtained in the same manner as in Example 2 except that the above-mentioned toner particle A (black) is used instead of the toner particle B (black), in Example 2.

Example 5

To each 100 parts of the above-mentioned toner particle C (black), toner particle C (cyan), toner particle C (magenta) and toner particle C (yellow) are mixed 2 parts of the above-mentioned mono-dispersed spherical silica A, 1 part by weight of the titanium oxide (a), 0.8 parts of the fumed silica D, 0.5 parts of cerium oxide and 0.3 parts of the lubricant A, as outer additives, and they are blended for 15 minutes at a peripheral speed of 32 m/s by a Henschel mixer, then, coarse particles are removed using a sieve of 45 μm mesh, to obtain four color toners. The resulting toners are primary-stored in hoppers respectively, and charged into a cartridge from the hoppers via an auger, then, the carrier A is charged at a ratio of 15 g of the carrier per 100 g of the toner, and wrapping is performed to obtain a toner cartridge containing four color carriers (the content of carriers in a replenishing toner is about 13.0%).

On the other hand, 8 parts of the above-mentioned toner and 100 parts of the above-mentioned carrier A are stirred for 20 minutes at 40 rpm using a V-shaped blender, and sieved through a sieve having a mesh of 177 μm, to obtain a four-color start developer.

Example 6

A carrier-containing toner cartridge including only black color and a start developer are obtained in the same manner as in Example 5 except that the carrier B is used instead of the carrier A, in the black toner obtained in Example 5.

Example 7

A carrier-containing toner cartridge including only black color and a start developer are obtained in the same manner as in Example 5 except that the carrier C is used instead of the carrier A, in the black toner obtained in Example 5.

Example 8

To 100 parts of the above-mentioned toner particle D (black) is mixed 2 parts of the above-mentioned mono-dispersed spherical silica A, 1 part by weight of the titanium oxide (a), 0.8 parts of the fumed silica D, 0.5 parts of cerium oxide and 0.3 parts of the lubricant (a), as outer additives, and they are blended for 15 minutes at a peripheral speed of 32 m/s by a Henschel mixer, then, coarse particles are removed using a sieve of 45 μm mesh, to obtain a toner. The resulting toner is primary-stored in a hopper, and charged into a cartridge from the hopper via an auger, then, the carrier A is charged at a ratio of 15 g of the carrier per 100 g of the toner, and wrapping is performed to obtain a carrier-containing toner cartridge (the content of a carrier in a replenishing toner is about 13.0%).

On the other hand, 8 parts of the above-mentioned toner and 100 parts of the above-mentioned carrier A are stirred for 20 minutes at 40 rpm using a V-shaped blender, and sieved through a sieve having a mesh of 177 μm, to obtain a start developer.

Example 9

To 100 parts of the above-mentioned toner particle C (black) is mixed 2 parts of the above-mentioned silicone resin particle, 1 part by weight of the titanium oxide (a), 0.8 parts of the fumed silica D, 0.5 parts of cerium oxide and 0.3 parts of the lubricant A, as outer additives, and they are blended for 15 minutes at a peripheral speed of 32 m/s by a Henschel mixer, then, coarse particles are removed using a sieve of 45 μm mesh, to obtain a toner. The resulting toner is primary-stored in a hopper, and charged into a cartridge from the hopper via an auger, then, the carrier A is charged at a ratio of 15 g of the carrier per 100 g of the toner, and wrapping is performed to obtain a carrier-containing toner cartridge (the content of a carrier in a replenishing toner is about 13.0%).

On the other hand, 8 parts of the above-mentioned toner and 100 parts of the above-mentioned carrier A are stirred for 20 minutes at 40 rpm using a V-shaped blender, and sieved through a sieve having a mesh of 177 μm, to obtain a start developer.

Example 10

A carrier-containing toner cartridge and a start developer are obtained in the same manner as in Example 9 except that the above-mentioned polymethyl methacrylate resin particle is used instead of the silicone resin particle, in Example 9.

Example 11

A carrier-containing toner cartridge and a start developer are obtained in the same manner as in Example 9 except that the lubricant (b) is used instead of the lubricant (a), in Example 9.

Example 12

A carrier-containing toner cartridge and a start developer are obtained in the same manner as in Example 9 except that the lubricant (a) is omitted, in Example 9.

Example 13

A carrier-containing toner cartridge and a start developer are obtained in the same manner as in Example 9 except that cerium oxide is omitted, in Example 9.

Example 14

To 100 parts of the above-mentioned toner particle C (cyan) is mixed 1 part of the above-mentioned titanium oxide (b), 1 part by weight of the titanium oxide (a), 0.8 parts of the fumed silica D, 0.5 parts of cerium oxide and 0.3 parts of the lubricant A, as outer additives, and they are blended for 15 minutes at a peripheral speed of 32 m/s by a Henschel mixer, then, coarse particles are removed using a sieve of 45 μm mesh, to obtain a toner. The resulting toner is primary-stored in a hopper, and charged into a cartridge from the hopper via an auger, then, the carrier A is charged at a ratio of 15 g of the carrier per 100 g of the toner, and wrapping is performed to obtain a carrier-containing toner cartridge (the content of a carrier in a replenishing toner is about 13.0%).

On the other hand, 8 parts of the above-mentioned toner and 100 parts of the above-mentioned carrier A are stirred for 20 minutes at 40 rpm using a V-shaped blender, and sieved through a sieve having a mesh of 177 μm, to obtain a start developer.

Example 15

A carrier-containing toner cartridge and a start developer are obtained in the same manner as in Example 14 except that the above-mentioned fumed silica G is used instead of the titanium oxide (b), in Example 14.

Example 16

A carrier-containing toner cartridge including only cyan color is obtained in the same manner as in Example 5 except that the charge amount of the carrier A is changed from 15 g to 6 g, in the cyan toner obtained in Example 5 (the content of a carrier in a replenishing toner is about 6.4%). In the present example, the same start developer as in Example 5 is used.

Example 17

A carrier-containing toner cartridge including only cyan color is obtained in the same manner as in Example 5 except that the charge amount of the carrier A is changed from 15 g to 65 g, in the cyan toner obtained in Example 5 (the content of a carrier in a replenishing toner is about 39.4%). In the present example, the same start developer as in Example 5 is used.

Comparative Example 1

A carrier-containing toner cartridge including only cyan color is obtained in the same manner as in Example 5 except that the cyan toner obtained in Example 5 is charged into a cartridge in the same manner as in Example 5, then, wrapping is conducted without charging a carrier (the content of a carrier in a replenishing toner is about 0%). In the present comparative example, the same start developer as in Example 5 is used.

Comparative Example 2

A carrier-containing toner cartridge including only cyan color is obtained in the same manner as in Example 5 except that the charge amount of the carrier A is changed from 15 g to 200 g, in the cyan toner obtained in Example 5 (the content of a carrier in a replenishing toner is about 66.7%). In the present example, the same start developer as in Example 5 is used.

Example 18

A carrier-containing toner cartridge including only black color and a start developer are obtained in the same manner as in Example 5 except that the carrier D is used instead of the carrier A, in the black toner obtained in Example 5.

Example 19

A carrier-containing toner cartridge including only black color and a start developer are obtained in the same manner as in Example 5 except that the carrier E is used instead of the carrier A, in the black toner obtained in Example 5.

Example 20

A carrier-containing toner cartridge including only black color and a start developer are obtained in the same manner as in Example 5 except that the carrier F is used instead of the carrier A, in the black toner obtained in Example 5.

[Evaluation Test]

The carrier-containing toner cartridges and start developers obtained in Examples 1 to 19 and Comparative Example 1 to 2 are used, and developing property and transferring property thereof are evaluated by a modified machine of C2220 which is a tandem mode machine adopting a trickle developing system manufactured by Fuji Xerox K. K. (modification: a start developer and a carrier-containing toner cartridge can be exchanged in each test, process speed can be controlled from outside, forced stop is possible, and in this operation, a toner can be sampled as described later from the surfaces of an electrostatic latent image holding member and intermediate image-receiving member).

<Evaluation of Developing Property>

(Solid Development Amount)

a) Initial

A start developer is allowed to stand over night under given temperatures and humidities (under 29° C., 90% RH, and under 10° C., 20% RH), an image having two solid patches of 2 cm×5 cm is copied, an apparatus is forcibly stopped before transfer onto paper, and the development amount (amount of a toner before transfer onto paper) is measured. Specifically, precisely weighed two tapes are prepared, two developed parts on the surface of a photorecepter (electrostatic latent image holding member) are transferred to the above-mentioned tapes utilizing adherence, the tapes after toner adhered are precisely weighed again, weights of the tapes before collection of a toner are subtracted from these precisely weighed weights and the differences are averaged to give the development amount, and this is used for evaluation of the initial developing property. The preferable value is from 4.0 to 5.0 g/m$^2$.

b) After 100000 Pieces 100000 (A4 longitudinal) copies are obtained under given temperatures and humidities (under 29° C., 90% RH, and under 10° C., 20% RH), using a start developer. The copies are further allowed to stand over night without changing the temperature and humidity conditions, then, an image having two solid patches of 2 cm×5 cm is copied, an apparatus is forcibly stopped and the development amount is measured. Specifically, precisely weighed two tapes are prepared, two developed parts on the surface of a photorecepter are transferred to the tapes utilizing adherence, the tapes after toner adhered are precisely weighed again, weights of the tapes before collection of a toner are subtracted from these precisely weighed weights and the differences are averaged to give the development amount, and this is used for evaluation of developing property after 100000 copies.

(Fogging)

When a toner is collected by a tape from the surface of a photorecepter at initial time and after 100000 pieces in the above-mentioned (solid development amount), background parts at a position remote by 10 mm from the above-mentioned solid patch are adhered to a tape in the same manner as in <Evaluation of developing property>, and the number of toners per 1 cm$^2$ of the tape is counted, and fogging is evaluated as follows: less than 100; ○, from 100 to 200; Δ, more than 200; X.

<Measurement of Charge Amount at Initial Time and After 100000>

At the initial time and after 100000 pieces in the above-mentioned <Evaluation of developing property>, a developer on the surface of Magsleeve (developer holding member) in a developer apparatus is collected, and the charge amount is measured by TB200 manufactured by Toshiba Corp. under conditions of 25° C. and 55% RH.

<Evaluation of Transferring Property at Initial Time and After 100000>

At the initial time and after 100000 pieces in the above-mentioned <Evaluation of developing property>, an image having two solid patches of 2 cm×5 cm is copied, and an apparatus is forcibly stopped after completion of a transferring process and before a fixing process, and the transfer efficiency is measured. Specifically, four precisely weighed tapes are prepared, toners on the above-mentioned parts at which two solid patches are formed on the surface of an intermediate transfer are transferred to the above-mentioned tapes utilizing adherence, the tapes after toner adhered are precisely weighed again, weights of the tapes before collection of a toner are subtracted from these precisely weighed weights and the differences are averaged to give the transferred toner amount a, and the amount b of toners remaining on the above-mentioned parts at which two patches are formed on the surface of a photorecepter is measured likewise using remaining tapes, and the transfer efficiency η (%) is calculated by the following formula (3).

Transfer efficiency $\eta$ (%)=$a \times 100/(a+b)$

The transfer efficiency η (%) is preferably 95% or more and evaluated as follows: $\eta \geqq 95\%$; ○, $85\% \leqq \eta < 95\%$; Δ, $80\% \leqq \eta < 85\%$; ▲, $\eta < 80\%$; X.

<Evaluation of Cleaning Property: Stress Test>

(Whole Surface Solid Evaluation)

At the initial time and after 100000 pieces in the above-mentioned <Evaluation of developing property>, an electrostatic latent image holding member is rotated 100 times while charging, under no-developed condition and at a process speed of 104 mm/s. Then, the whole surface solid image is formed on the surface of an electrostatic latent image holding member at a process speed of 104 mm/s, the surface of the electrostatic latent image holding member is cleaned by a cleaning equipment in the apparatus under no-transferred condition. This operation is repeated, and the degree of cleaning is evaluated, and the results are used for evaluating cleaning property of whole surface solid. Evaluation indices are as follows. G1 to G3 have no practical problem.

- G1: Cleaning of the whole surface 3 times or more continuously is possible without problem
- G2: Cleaning of the whole surface once is possible without problem
- G3: Cleaning of the whole surface is impossible from the first try, and poor cleaning in the form of several stripes occurs G4: Cleaning of the whole surface is impossible from the first try, and poor cleaning in the form of band occurs (Evaluation Blade-Squeal)

At the initial time and after 100000 pieces in the above-mentioned <Evaluation of developing property>, an electrostatic latent image holding member is rotated for 10 minutes while charging, under no-developed condition and at a process speed of 194 mm/s. Thereafter, the process speed is switched to 104 mm/s, and blade-squeal of a blade is evaluated. The evaluation indices are as described below. G1 to G3 have no practical problem.

G1: No generation of abnormal sound and the like

G2: Thought slight blade-squeal occurs directly after speed reduction, it disappears after several copies (audible when the front surface of a machine is opened and ears approach the machine, and negligible under normal condition)

G3: Slight blade-squeal occurs (audible when the front surface of a machine is opened and ears approach the machine, and negligible under normal condition)

G4: Blade-squeal occurs in speed reduction, and does not disappear thereafter (audible under usual operation)

Example 21

100000 pieces of paper is printed in the above-mentioned evaluation test using the start developer and carrier-containing toner cartridge in Example 5, then, excess portions of all four color developers recovered by a trickle development system (developer recovering mechanism) are separated into toners and carriers by using a turbo shifter equipped with a 20 $\mu$m mesh. The separated carrier had a volume specific resistivity of $10^{15}$ Ω·cm. To 100 g of the resulting carrier is added 50 g of the above-mentioned new carrier A, to prepare a new carrier G. The new carrier G had a volume specific resistivity of $10^{13}$ Ω·cm.

A carrier-containing toner cartridge including only cyan color and a start developer are obtained in the same manner as in Example 5 except that the carrier G is used instead of the carrier A, in the cyan toner obtained in Example 5.

Various evaluation tests are conducted in the same manner as in the other examples and comparative examples, using the resulting carrier-containing toner cartridge and start developer.

The evaluation results obtained from the above-mentioned examples and comparative examples are summarized in the following Tables 1 to 4. Tables 1 to 2 show the initial results, and Tables 3 and 4 show the results after 100000 pieces, respectively.

TABLE 1

| | Evaluation Result (initial) | | | | | | | | | |
|---|---|---|---|---|---|---|---|---|---|---|
| | Developing Property | | | | | | | | | |
| | Solid Development Amount (g/m$^2$) | | | | Fogging (Grade) | | | | Charge Amount ($\mu$C/g) | |
| | 29° C. 90% RH | | 10° C. 20% RH | | 29° C. 90% RH | | 10° C. 20% RH | | 29° C. 90% RH | 10° C. 20% RH |
| Example 1 | | | | | | | | | | |
| Cyan | 4.5 | ○ | 4.5 | ○ | 50 | ○ | 20 | ○ | 30 | 36 |
| Magenta | 4.8 | ○ | 4.7 | ○ | 60 | ○ | 30 | ○ | 28 | 33 |
| Yellow | 4.2 | ○ | 4.1 | ○ | 40 | ○ | 10 | ○ | 35 | 40 |
| Black | 4.8 | ○ | 4.6 | ○ | 50 | ○ | 30 | ○ | 30 | 35 |
| Example 2 Black | 4.7 | ○ | 4.5 | ○ | 55 | ○ | 32 | ○ | 29 | 32 |
| Example 3 Black | 4.7 | ○ | 4.5 | ○ | 58 | ○ | 35 | ○ | 29 | 33 |
| Example 4 Black | 4.2 | ○ | 4.0 | ○ | 89 | ○ | 75 | ○ | 25 | 32 |
| Example 5 | | | | | | | | | | |
| Cyan | 4.5 | ○ | 4.5 | ○ | 52 | ○ | 30 | ○ | 32 | 38 |
| Magenta | 4.8 | ○ | 4.8 | ○ | 62 | ○ | 35 | ○ | 29 | 30 |
| Yellow | 4.3 | ○ | 4.2 | ○ | 42 | ○ | 15 | ○ | 36 | 42 |
| Black | 4.6 | ○ | 4.5 | ○ | 52 | ○ | 35 | ○ | 31 | 34 |
| Example 6 Black | 4.8 | ○ | 4.5 | ○ | 88 | ○ | 35 | ○ | 28 | 30 |
| Example 7 Black | 4.2 | ○ | 4.0 | ○ | 35 | ○ | 45 | ○ | 38 | 42 |
| Example 8 Black | 4.9 | ○ | 4.9 | ○ | 78 | ○ | 75 | ○ | 35 | 38 |
| Example 9 Black | 4.7 | ○ | 4.2 | ○ | 98 | ○ | 85 | ○ | 28 | 37 |
| Example 10 Black | 4.5 | ○ | 4.4 | ○ | 90 | ○ | 78 | ○ | 33 | 35 |
| Example 11 Black | 4.7 | ○ | 4.5 | ○ | 55 | ○ | 42 | ○ | 32 | 33 |
| Example 12 Black | 4.8 | ○ | 4.7 | ○ | 45 | ○ | 38 | ○ | 35 | 37 |

TABLE 1-continued

| | Evaluation Result (initial) | | | | | | | | | |
|---|---|---|---|---|---|---|---|---|---|---|
| | Developing Property | | | | | | | | | |
| | Solid Development Amount ($g/m^2$) | | | | Fogging (Grade) | | | | Charge Amount ($\mu C/g$) | |
| | 29° C. 90% RH | | 10° C. 20% RH | | 29° C. 90% RH | | 10° C. 20% RH | | 29° C. 90% RH | 10° C. 20% RH |
| Example 13 Black | 4.6 | ○ | 4.5 | ○ | 38 | ○ | 35 | ○ | 37 | 39 |
| Example 14 Cyan | 5.0 | ○ | 4.8 | ○ | 95 | ○ | 69 | ○ | 30 | 32 |
| Example 15 Cyan | 5.0 | ○ | 4.2 | ○ | 65 | ○ | 99 | ○ | 25 | 58 |
| Example 16 Cyan | 4.4 | ○ | 4.5 | ○ | 53 | ○ | 32 | ○ | 32 | 38 |
| Example 17 Cyan | 4.3 | ○ | 4.6 | ○ | 55 | ○ | 30 | ○ | 33 | 38 |
| Comp. Ex. 1 Cyan | 4.5 | ○ | 4.5 | ○ | 56 | ○ | 32 | ○ | 32 | 38 |
| Comp. Ex. 2 Cyan | 4.7 | ○ | 4.6 | ○ | 52 | ○ | 35 | ○ | 30 | 36 |
| Example 18 Black | 4.2 | ○ | 4.0 | ○ | 60 | ○ | 55 | ○ | 35 | 36 |
| Example 19 Black | 4.9 | ○ | 4.5 | ○ | 65 | ○ | 45 | ○ | 28 | 34 |
| Example 20 Black | 5.2 | Δ | 4.2 | ○ | 110 | Δ | 55 | ○ | 25 | 42 |
| Example 21 Cyan | 4.8 | ○ | 4.3 | ○ | 55 | ○ | 45 | ○ | 30 | 35 |

TABLE 2

| | Evaluation Result (initial) | | | | | | |
|---|---|---|---|---|---|---|---|
| | Transferring Property (Transfer Efficiency η %) | | | | Cleaning Property, Stress Test | | |
| | 29° C. 90% RH | | 10° C. 20% RH | | Whole Surface Solid | Blade Screaming | Remarks |
| Example 1 | | | | | | | |
| Cyan | 98.5 | ○ | 98.8 | ○ | G1 | G1 | |
| Magenta | 97.5 | ○ | 96.3 | ○ | G1 | G1 | |
| Yellow | 96.3 | ○ | 95.5 | ○ | G1 | G1 | |
| Black | 99.2 | ○ | 99.8 | ○ | G1 | G1 | |
| Example 2 Black | 99.0 | ○ | 99.5 | ○ | G1 | G1 | |
| Example 3 Black | 97.5 | ○ | 96.5 | ○ | G1 | G1 | |
| Example 4 Black | 90.8 | Δ | 91.2 | Δ | G1 | G1 | |
| Example 5 | | | | | | | |
| Cyan | 97.5 | ○ | 97.3 | ○ | G1 | G1 | |
| Magenta | 96.7 | ○ | 97.0 | ○ | G1 | G1 | |
| Yellow | 95.0 | ○ | 95.5 | ○ | G1 | G1 | |
| Black | 98.0 | ○ | 98.5 | ○ | G1 | G1 | |
| Example 6 Black | 97.0 | ○ | 98.5 | ○ | G1 | G1 | |
| Example 7 Black | 97.5 | ○ | 93.5 | Δ | G1 | G1 | *1 |
| Example 8 Black | 99.8 | ○ | 99.9 | ○ | G3 | G3 | *2 |
| Example 9 Black | 89.0 | Δ | 91.8 | Δ | G2 | G3 | |
| Example 10 Black | 88.5 | Δ | 90.8 | Δ | G2 | G3 | |

TABLE 2-continued

| | Evaluation Result (initial) | | | | | | |
|---|---|---|---|---|---|---|---|
| | Transferring Property (Transfer Efficiency η %) | | | | Cleaning Property, Stress Test | | |
| | 29° C. 90% RH | | 10° C. 20% RH | | Whole Surface Solid | Blade Screaming | Remarks |
| Example 11 Black | 97.8 | ○ | 98.0 | ○ | G1 | G1 | |
| Example 12 Black | 97.0 | ○ | 97.0 | ○ | G1 | G1 | |
| Example 13 Black | 98.0 | ○ | 96.5 | ○ | G1 | G2 | |
| Example 14 Cyan | 88.0 | Δ | 91.2 | Δ | G2 | G3 | OHP Transparency Decrease |
| Example 15 Cyan | 86.0 | Δ | 85.0 | Δ | G2 | G3 | Significant Temperature and Humidity Influence |
| Example 16 Cyan | 97.0 | ○ | 97.2 | ○ | G1 | G1 | |
| Example 17 Cyan | 97.1 | ○ | 97.2 | ○ | G1 | G1 | |
| Comp. Ex. 1 Cyan | 97.3 | ○ | 97.4 | ○ | G1 | G1 | |
| Comp. Ex. 2 Cyan | 97.0 | ○ | 96.2 | ○ | G1 | G1 | |
| Example 18 Black | 97.5 | ○ | 98.0 | ○ | G1 | G1 | *3 |
| Example 19 Black | 98.0 | ○ | 98.5 | ○ | G1 | G1 | |
| Example 20 Black | 96.2 | ○ | 95.4 | ○ | G1 | G1 | Significant Temperature and Humidity Influence |
| Example 21 Cyan | 97.2 | ○ | 97.8 | ○ | G1 | G1 | |

*1: Slight one stripe defect occurred at tone change region on half tone 1 (Cin 60%) and half tone (Cin 40%) images (permissible level)
*2: Slight image dots [image concentration change in the form of band] occurred under vibration of operation of machine body (permissible level)
*3: Defects occurred around letters (permissible level)

TABLE 3

| | Evaluation Results (After 100000 Pieces) | | | | | | | | | |
|---|---|---|---|---|---|---|---|---|---|---|
| | Developing Property | | | | | | | | | |
| | Solid Development Amount ($g/m^2$) | | | | Fogging (Grade) | | | | Charge Amount ($\mu C/g$) | |
| | 29° C. 90% RH | | 10° C. 20% RH | | 29° C. 90% RH | | 10° C. 20% RH | | 29° C. 90% RH | 10° C. 20% RH |
| Example 1 | | | | | | | | | | |
| Cyan | 4.5 | ○ | 4.5 | ○ | 52 | ○ | 25 | ○ | 31 | 36 |
| Magenta | 4.7 | ○ | 4.7 | ○ | 63 | ○ | 32 | ○ | 30 | 35 |
| Yellow | 4.2 | ○ | 4.2 | ○ | 45 | ○ | 15 | ○ | 36 | 42 |
| Black | 4.8 | ○ | 4.6 | ○ | 55 | ○ | 35 | ○ | 32 | 37 |
| Example 2 Black | 4.7 | ○ | 4.5 | ○ | 58 | ○ | 35 | ○ | 29 | 32 |
| Example 3 Black | 4.7 | ○ | 4.6 | ○ | 63 | ○ | 40 | ○ | 27 | 33 |
| Example 4 Black | 4.2 | ○ | 4.0 | ○ | 130 | Δ | 105 | Δ | 28 | 35 |
| Example 5 | | | | | | | | | | |
| Cyan | 4.6 | ○ | 4.6 | ○ | 55 | ○ | 35 | ○ | 33 | 37 |
| Magenta | 4.7 | ○ | 4.9 | ○ | 65 | ○ | 40 | ○ | 31 | 30 |
| Yellow | 4.3 | ○ | 4.4 | ○ | 45 | ○ | 25 | ○ | 35 | 41 |

TABLE 3-continued

| | Evaluation Results (After 100000 Pieces) | | | | | | | | | |
|---|---|---|---|---|---|---|---|---|---|---|
| | Developing Property | | | | | | | | | |
| | Solid Development Amount ($g/m^2$) | | | | Fogging (Grade) | | | | Charge Amount ($\mu C/g$) | |
| | 29° C. 90% RH | | 10° C. 20% RH | | 29° C. 90% RH | | 10° C. 20% RH | | 29° C. 90% RH | 10° C. 20% RH |
| Black | 4.5 | ○ | 4.6 | ○ | 53 | ○ | 35 | ○ | 31 | 35 |
| Example 6 Black | 4.8 | ○ | 4.5 | ○ | 99 | ○ | 45 | ○ | 20 | 32 |
| Example 7 Black | 4.0 | ○ | 4.0 | ○ | 35 | ○ | 45 | ○ | 42 | 45 |
| Example 8 Black | 4.9 | ○ | 4.9 | ○ | 76 | ○ | 70 | ○ | 38 | 40 |
| Example 9 Black | 5.3 | Δ | 4.8 | ○ | 150 | Δ | 115 | Δ | 18 | 25 |
| Example 10 Black | 4.8 | ○ | 4.4 | ○ | 100 | Δ | 78 | ○ | 22 | 28 |
| Example 11 Black | 4.6 | ○ | 4.5 | ○ | 58 | ○ | 40 | ○ | 33 | 33 |
| Example 12 Black | 4.8 | ○ | 4.7 | ○ | 48 | ○ | 35 | ○ | 34 | 36 |
| Example 13 Black | 4.6 | ○ | 4.3 | ○ | 38 | ○ | 30 | ○ | 38 | 42 |
| Example 14 Cyan | 5.3 | Δ | 4.8 | ○ | 110 | Δ | 99 | ○ | 25 | 28 |
| Example 15 Cyan | 5.5 | Δ | 4.0 | Δ | 125 | Δ | 110 | Δ | 20 | 65 |
| Example 16 Cyan | 4.8 | ○ | 4.5 | ○ | 100 | Δ | 77 | ○ | 28 | 30 |
| Example 17 Cyan | 4.4 | ○ | 4.6 | ○ | 56 | ○ | 33 | ○ | 35 | 38 |
| Comp. Ex. 1 Cyan | 4.2 | ○ | 4.3 | ○ | 300 | X | 280 | X | 18 | 20 |
| Comp. Ex. 2 Cyan | 4.6 | ○ | 4.6 | ○ | 52 | ○ | 35 | ○ | 32 | 36 |
| Example 18 Black | 4.2 | ○ | 3.9 | Δ | 60 | ○ | 75 | ○ | 38 | 39 |
| Example 19 Black | 4.9 | ○ | 4.5 | ○ | 180 | Δ | 170 | Δ | 21 | 22 |
| Example 20 Black | 5.5 | Δ | 4.8 | ○ | 190 | Δ | 155 | Δ | 15 | 22 |
| Example 21 Cyan | 4.9 | ○ | 4.5 | ○ | 75 | ○ | 65 | ○ | 28 | 30 |

TABLE 4

| | Evaluation Results (After 100000 Pieces) | | | | | | |
|---|---|---|---|---|---|---|---|
| | Transferring Property (transfer efficiency $\mu$ %) | | | | Cleaning Property, Stress Test | | |
| | 29° C. 90% RH | | 10° C. 20% RH | | Whole Surface Solid | Blade Screaming | Remarks |
| Example 1 | | | | | | | |
| Cyan | 96.5 | ○ | 95.8 | ○ | G2 | G1 | |
| Magenta | 96.5 | ○ | 95.3 | ○ | G2 | G1 | |
| Yellow | 97.3 | ○ | 95.5 | ○ | G2 | G1 | |
| Black | 99.2 | ○ | 99.8 | ○ | G2 | G1 | |
| Example 2 Black | 99.0 | ○ | 99.5 | ○ | G2 | G1 | |
| Example 3 Black | 93.5 | Δ | 92.5 | Δ | G2 | G1 | |
| Example 4 Black | 85.0 | Δ | 86.0 | Δ | G1 | G1 | *4 |
| Example 5 | | | | | | | |
| Cyan | 97.2 | ○ | 97.0 | ○ | G1 | G1 | |

TABLE 4-continued

| | Evaluation Results (After 100000 Pieces) | | | | | | |
|---|---|---|---|---|---|---|---|
| | Transferring Property (transfer efficiency μ %) | | | | Cleaning Property, Stress Test | | |
| | 29° C. 90% RH | | 10° C. 20% RH | | Whole Surface Solid | Blade Screaming | Remarks |
| Magenta | 96.0 | ○ | 96.0 | ○ | G1 | G1 | |
| Yellow | 95.0 | ○ | 95.0 | ○ | G1 | G1 | |
| Black | 96.0 | ○ | 96.5 | ○ | G1 | G1 | |
| Example 6 Black | 95.0 | ○ | 96.5 | ○ | G1 | G1 | |
| Example 7 Black | 97.5 | ○ | 94.5 | Δ | G1 | G1 | *1 |
| Example 8 Black | 95.8 | ○ | 94.9 | Δ | G3 | G1 | *2 |
| Example 9 Black | 80.0 | ▲ | 81.8 | ▲ | G2 | G1 | |
| Example 10 Black | 82.5 | ▲ | 80.8 | ▲ | G2 | G1 | |
| Example 11 Black | 97.6 | ○ | 98.5 | ○ | G1 | G1 | |
| Example 12 Black | 97.0 | ○ | 97.0 | ○ | G3 | G2 | *5 |
| Example 13 Black | 98.5 | ○ | 96.7 | ○ | G2 | G3 | |
| Example 14 Cyan | 80.0 | ▲ | 81.2 | ▲ | G2 | G1 | OHP Transparency Decrease |
| Example 15 Cyan | 80.0 | ▲ | 80.0 | ▼ | G2 | G3 | Significant Temperature and Humidity Influence |
| Example 16 Cyan | 96.0 | ○ | 97.2 | ○ | G1 | G1 | |
| Example 17 Cyan | 96.1 | ○ | 97.2 | ○ | G1 | G1 | *6 |
| Comp. Ex. 1 Cyan | 88.3 | Δ | 95.4 | ○ | G1 | G1 | *7 |
| Comp. Ex. 2 Cyan | 97.0 | ○ | 96.2 | ○ | G4 | G4 | *8 |
| Example 18 Black | 96.5 | ○ | 96.0 | ○ | G1 | G1 | *3 |
| Example 19 Black | 87.1 | ▲ | 95.5 | ○ | G1 | G1 | |
| Example 20 Black | 88.2 | ▲ | 92.4 | Δ | G1 | G1 | |
| Example 21 Cyan | 95.2 | ○ | 96.8 | ○ | G1 | G1 | |

*1 to 3: As described in the lower column of Table 2
*4: Graininess deteriorated (permissible level)
*5: Latent image support is abraded, blade abrasion is significant
*6: Exchange frequency of developer recover Box increased (recover Box is exchanged until 100000 pieces at a probability of 10%)
*7: Image dots ascribed to low charge transfer spot under high temperature and high humidity occurred
*8: Owing to developer leakage from the end portion of a developer support, development occurred on the latent image support, and latent image support blemish and blade blemish occurred, and color points are formed on images and cleaning failure occurred As described above, the present invention can provide an image formation method which remarkably elongates the developer life and can also realize maintenance-free operation, using a tandem type image formation apparatus which provides size reduction and high speed coloring, a replenishing toner used in this method and a method of producing the same, and a carrier-containing toner cartridge.

What is claimed is:

1. A method for forming an image with at least one xerography unit of a plurality of xerography units in an image formation apparatus, comprising:

charging a surface of an electrostatic latent image holding member;

forming the electrostatic latent image on the charged surface of the image holding member;

developing the electrostatic latent image to form a toner image using a developer containing a toner and a carrier on a developer holding member in a developing apparatus; and transferring the toner image onto an image member wherein the developing apparatus further includes a step of replenishing a replenisher toner into the developing apparatus by a replenishing system, and a step of discharging the developer from the developing apparatus to recover an excess portion of the developer by a discharging system, the replenisher toner containing a replenishing toner and a replenishing carrier, said carrier is in a range of 5 to 40% by weight thereof and having a coating on a core, said coating containing a resin and a conductive material, and said resin being composed of at least a monomer containing a carboxyl group, a monomer containing fluorine, an alkyl methacrylate monomer having a branch with 3 to 10 carbon atoms, and at least one of an alkyl methacrylate monomer containing a linear alkyl group with 1 to 3 carbon atoms and an alkyl acrylate monomer containing a linear alkyl group with 1 to 3 carbon atoms.

2. A method for forming an image according to claim 1, wherein the toner and the replenishing toner comprise a volume average particle size of 3 to 10 $\mu$m and a toner shape factor SF1, according to the formula $$SF1=R^2/A\times\pi/4\times100$$

in which R represents maximum length of a toner particle and A represents projected area of the toner particle, of from 110 to 135.

3. A method for forming an image according to claim 1, further comprising the step of, after the step of transferring the toner image, cleaning the surface of the electrostatic latent image holding member.

4. A method for forming an image according to claim 1, wherein a processing speed of said image formation apparatus is switchable at least one of automatically and manually.

5. A method for forming an image according to claim 1, wherein said step of charging the surface is performed by charging means including a roll charging-type charging apparatus.

6. A method for forming an image according to claim 1, wherein the replenishing carrier in the replenishing toner comprises a volume specific resistivity of from $10^7$ to $10^{14}$ $\Omega\cdot$cm.

7. A method for forming an image according to claim 1, wherein the monomer containing a carboxyl group comprises a compounding amount with respect to all monomers in the resin of from 0.1 to 15.0% by weight.

8. A method for forming an image according to claim 1, wherein the monomer containing fluorine comprises a compounding amount with respect to all monomers in the resin of from 0.1 to 50.0% by weight.

9. A method for forming an image according to claim 1, wherein a weight ratio between content in the resin of the at least one monomer having a linear alkyl group with 1 to 3 carbon atoms and content in the resin of the monomer having a branch with 3 to 10 carbon atoms is in the range from 10:90 to 90:10.

10. A method for forming an image with at least one xerography unit of a plurality of xerography units in an image formation apparatus, comprising:

charging a surface of an electrostatic latent image holding member;

forming the electrostatic latent image on the charged surface of the image holding member;

developing the electrostatic latent image to form a toner image using a developer containing a toner and a carrier on a developer holding member in a developing apparatus; and transferring the toner image onto an image receiving member, wherein the developing apparatus further includes a step of replenishing a replenisher toner into the developing apparatus by a replenishing system, and a step of discharging the developer from a-developing apparatus to recover an excess portion of the developer by a discharging system, the replenisher toner containing a replenishing toner and a replenishing carrier, said carrier is in a range of 5 to 40% by weight thereof and having a coating on a core, said replenishing toner comprising a volume average particle size of 3 to 10 $\mu$m and a toner shape factor SF1, according to the formula $SF1=R^2/A\times\pi/4\times100$ in which R represents maximum length of a toner particle and A represents projected area of the toner particle, of from 110 to 135.

11. A method for forming an image according to claim 10, wherein the replenishing toner comprises, as a toner outer additive, silica with a true specific gravity of 1.3 to 1.9 and a volume average particle size of 80 to 300 nm.

12. A method for forming an image according to claim 10, further comprising the step of, after the step of transferring the toner image, cleaning the surface of the electrostatic latent image holding member.

13. A method for forming an image according to claim 10, wherein a processing speed of said image formation apparatus is switchable at least one of automatically and manually.

14. A method for forming an image according to claim 10, wherein said step of charging the surface is performed by charging means including a roll charging-type charging apparatus.

15. A replenisher toner, which is usable in the step of replenishing the replenishing toner in the method for forming the image according to claim 1.

16. A replenisher toner, which is usable in the step of replenishing the replenishing toner in the method for forming the image according to claim 10.

17. A method of producing a replenishing toner, the method comprising:

separating a carrier from the excess developer recovered by said step of recovering the excess portion of the developer in the method for forming the image according to claim 1; and mixing a carrier as a replenishing carrier with a replenishing toner.

18. A method of producing a replenishing toner, the method comprising:

separating a carrier from the excess developer recovered by said step of recovering excess portion of the developer in the method for forming the image according to claim 10; and mixing a carrier as a replenishing carrier with a replenishing toner.

19. A method of producing a replenishing toner according to claim 15, wherein the replenishing carrier to be mixed with the replenishing toner comprises a volume specific resistivity of from $10^7$ to $10^{14}$ $\Omega\cdot$cm.

20. A method of producing a replenishing toner according to claim 16, wherein the replenishing carrier to be mixed with the replenishing toner comprises a volume specific resistivity of from$10^7$ to $10^{14}$ $\Omega\cdot$cm.

21. A toner cartridge for replenishing a replenishing toner to a developing apparatus of an image formation apparatus, wherein the toner cartridge accommodates the replenishing toner according to claim 15.

22. A toner cartridge for replenishing a replenishing toner to a developing apparatus of an image formation apparatus, wherein the toner cartridge accommodates the replenishing toner according to claim 16.

* * * * *